US012722040B2

(12) United States Patent
Rutten et al.

(10) Patent No.: US 12,722,040 B2
(45) Date of Patent: Sep. 1, 2026

(54) OXYGEN TRAINER DEVICE

(71) Applicant: Sebastiaan Rutten, New Braunfels, TX (US)

(72) Inventors: Sebastiaan Rutten, New Braunfels, TX (US); Todd Metlen, New Braunfels, TX (US)

(73) Assignee: Sebastiaan Rutten, New Braunfels, TX (US)

( * ) Notice: Subject to any disclaimer, the term of this patent is extended or adjusted under 35 U.S.C. 154(b) by 0 days.

(21) Appl. No.: 18/027,435

(22) PCT Filed: Sep. 28, 2021

(86) PCT No.: PCT/US2021/052471
§ 371 (c)(1),
(2) Date: Mar. 21, 2023

(87) PCT Pub. No.: WO2022/072380
PCT Pub. Date: Apr. 7, 2022

(65) Prior Publication Data

US 2023/0338775 A1 Oct. 26, 2023

Related U.S. Application Data

(60) Provisional application No. 63/084,563, filed on Sep. 29, 2020.

(51) Int. Cl.
*A63B 23/18* (2006.01)
*A63B 21/00* (2006.01)

(52) U.S. Cl.
CPC ..... *A63B 23/18* (2013.01); *A63B 21/00069* (2013.01)

(58) Field of Classification Search
CPC ..... A63B 21/00061; A63B 21/00069; A63B 21/0088; A63B 21/015; A63B 23/18
See application file for complete search history.

(56) References Cited

U.S. PATENT DOCUMENTS 4,739,987 A 4/1988 Nicholson
5,658,221 A 8/1997 Hougen
(Continued)

FOREIGN PATENT DOCUMENTS

CN 108568063 A 9/2018
CN 214861021 U 11/2021
WO 96/38207 A1 12/1996

OTHER PUBLICATIONS

International Search Report and Written Opinion dated Jan. 14, 2022 in PCT International Patent Application No. PCT/US2021/052471, 8 pages.

*Primary Examiner* — Megan Anderson
(74) *Attorney, Agent, or Firm* — SNELL & WILMER L.L.P.

(57) ABSTRACT

An oxygen trainer system that includes a circulation body attachable to and in fluid communication with a mouthpiece. A valve cover can be mounted over a valve seat and a one-way valve. The valve can be configured to seal against the valve seat to prevent intake of air during inhalation into the circulation body from one or more exhaust apertures. A knob can be rotatably coupled to a second end of the circulation body. The knob can include an open end with one or more walls extended to a second end opposite the first end and an array of apertures positioned on the one or more walls between the first and second ends. The knob can be rotatable so that at least one of the apertures is alignable with an intake aperture of the system to control an air level resistance of the system.

17 Claims, 22 Drawing Sheets

(56) References Cited

U.S. PATENT DOCUMENTS

| | | | | |
|---|---|---|---|---|
| D875,237 | S * | 2/2020 | Ghazzawi | D24/110 |
| 2015/0231443 | A1* | 8/2015 | Halliday | A63B 23/18 482/13 |
| 2016/0346603 | A1* | 12/2016 | Halliday | A61M 16/208 |
| 2024/0149111 | A1* | 5/2024 | Poulsen | A61B 5/224 |

* cited by examiner

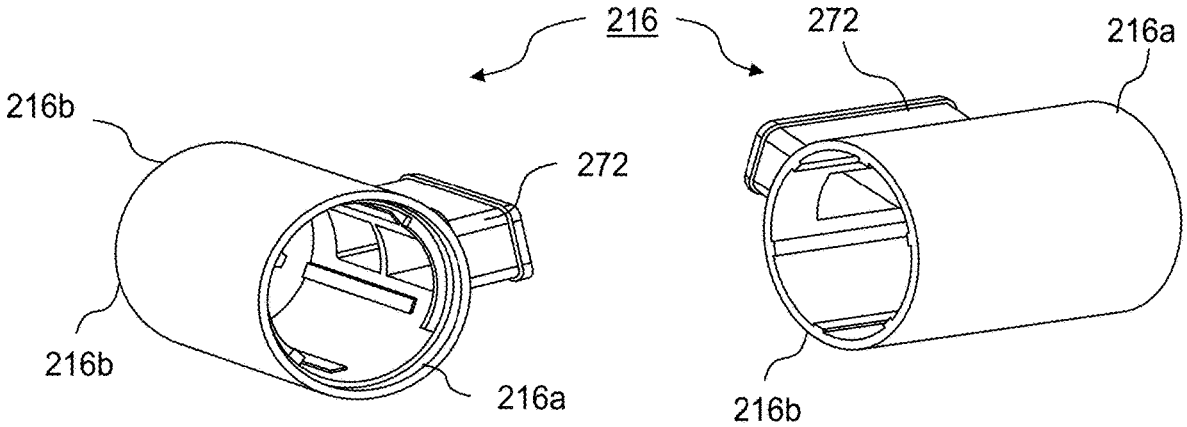
FIG. 18A
FIG. 18B
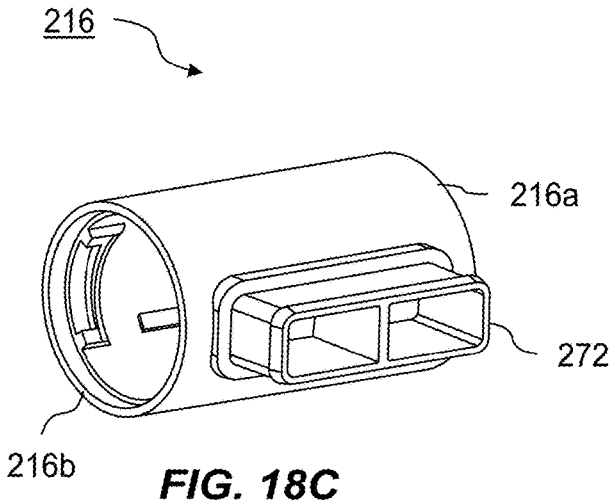
FIG. 18C

OXYGEN TRAINER DEVICE

CROSS-REFERENCE TO RELATED APPLICATIONS

This application claims priority to U.S. provisional patent application No. 63/084,563 filed Sep. 29, 2020, the contents of which are incorporated herein by reference in their entirety as if set forth verbatim.

FIELD

This disclosure relates to trainer devices for use by individuals, including athletes, to increase inspiratory muscular endurance.

BACKGROUND

The present disclosure relates generally to an oxygen trainer for use by individuals, including athletes as well as those who may have asthma, COPD, anxiety, PTSD, or any other condition, to increase their inspiratory muscular endurance.

The restriction of airflow into the mouth and lungs during athletic or aerobic conditioning, as well as other breathing exercises for asthma, COPD, anxiety, PTSD, or any other condition, strengthens the Inspiratory Muscles (the muscles responsible for breathing in). This may in turn support the lungs by improving their aspiratory muscular endurance.

It is understood that there are prior art devices that can simulate the restriction of airflow into the lungs in order to activate respiratory muscle endurance training. For instance, U.S. Patent Application No. 2008/0096728 discloses a respiratory muscle endurance training device wherein a duck-bill valve is used as a slit valve. U.S. Pat. Nos. 5,658,221, 5,899,832, 6,083,141, and 6,500,095 all disclose portable personal breathing apparatus that have a pair of coaxial cylinders each having slots which can be selectively aligned or misaligned to provide differing breathing resistance. U.S. Pat. No. 6,450,969 discloses a device for measuring inspiratory strength which uses a series of slots and holes to provide differing breathing resistance. U.S. Pat. No. 4,739,987 discloses a respiratory exerciser having a plurality of holes which are radially offset from the center of a circular base to affect regulation of breathing resistance. U.S. Pat. No. 4,601,465 discloses a device for stimulating the human respiratory system wherein a perforated disc having plural apertures may be removably mounted to the portable device to regulate breathing resistance.

Accordingly, there is a need in the art for an oxygen trainer assembly having application to various athletic or aerobic training activities, as well as breathing exercises for any number of conditions, that can be readily modified to provide a variable resistance for oxygen intake and exhaust in order to increase inspiratory muscular endurance while at the same time being portable, convenient to clean, relatively inexpensive, and reliable.

SUMMARY

According to an aspect of the present disclosure, there is provided an oxygen trainer system for use during athletic and/or an aerobic training to increase inspiratory muscular endurance. The oxygen trainer system can include a circulation body attachable to and in fluid communication with a mouthpiece. A valve seat can be coupled to a first end of the circulation body. A valve cover can be mounted over the valve seat and the first end of the circulation body. The valve cover can include one or more exhaust apertures. A one-way valve can be coupled to the valve seat and within the valve cover. The valve can be configured to seal against the valve seat to prevent intake of air during inhalation into the circulation body from the one or more exhaust apertures. A knob can be coupled to a second end of the circulation body. The knob can include an open end with one or more walls extended to a second end opposite the first end and an array of apertures positioned on the one or more walls between the first and second ends. The knob can be rotatable so that at least one of the apertures of the array of apertures is alignable with an intake aperture of the system to control an air level resistance of the system.

In accordance with certain aspects of the present disclosure, the first end of the circulation body is opposite the second end of the circulation body.

In accordance with certain aspects of the present disclosure, the intake aperture is positioned adjacent the second end (e.g., on the circulation body itself).

In accordance with certain aspects of the present disclosure, the at least one of the apertures of the array of apertures is radially alignable with the intake aperture In accordance with certain aspects of the present disclosure, the circulation body is substantially tubular.

In accordance with certain aspects of the present disclosure, the apertures of the array of apertures are selectively positioned circumferentially along the knob in a spiral.

In accordance with certain aspects of the present disclosure, the array of apertures include diameters ranging from approximately 1 mm and approximately 8 mm.

In accordance with certain aspects of the present disclosure, the mouthpiece is included with the system and is detachable from a mouthpiece receiver of the circulation body between the first and second ends.

In accordance with certain aspects of the present disclosure, the one or more exhaust apertures are axially aligned with a longitudinal axis of the circulation body.

In accordance with certain aspects of the present disclosure, the knob includes an outer knob having the array of apertures coupled to and selectively aligned with an inner knob with a second array of apertures, the inner knob being nested in the outer knob.

In accordance with certain aspects of the present disclosure, the one or more exhaust apertures are radially arranged along an outer surface of the valve cover, the valve cover being rotatably coupled to the first end.

In accordance with certain aspects of the present disclosure, the system includes an exhaust valve cover nested within the valve cover, the exhaust valve cover comprising an array of apertures so that rotating the valve cover relative to at least one aperture of the array of apertures of the exhaust valve cover controls an air level resistance of the system during exhalation.

In accordance with certain aspects of the present disclosure, the system includes a throttle body coupled to the second end of the circulation body. The knob can couple to the second end of the circulation body via the throttle body and the throttle body can include the intake aperture.

In accordance with certain aspects of the present disclosure, a method of using an oxygen trainer system is disclosed. The method can include adjusting an air level resistance of the system by rotating a knob comprising an array of apertures between one of a plurality of orientations relative to an end of a circulation body so that at least one aperture of the array of apertures of the knob is radially aligned with an intake aperture of the oxygen trainer system so that during inhalation from a mouthpiece of the system, intake of air is only permitted through the at least one aperture and the intake aperture.

In accordance with certain aspects of the present disclosure, the method can include positioning a one-way valve on an opposite side of the circulation body that seals against an exhaust valve seat to prevent intake of air into the circulation body from one or more exhaust apertures of a valve cover during inhalation.

In accordance with certain aspects of the present disclosure, the method can include axially aligning the one or more exhaust apertures with a longitudinal axis of the circulation body.

In accordance with certain aspects of the present disclosure, the method can include radially arranging the one or more exhaust apertures along an outer surface of the valve cover, the valve cover being rotatably coupled to the opposite side of the circulation body.

In accordance with certain aspects of the present disclosure, the method can include nesting an inner valve cover within the valve cover, the inner valve cover comprising an array of apertures; and rotating the valve cover relative to at least one aperture of the array of apertures of the inner valve cover to control an air level resistance of the system during exhalation.

In accordance with certain aspects of the present disclosure, the method can include moving the knob proximally or distally relative to the end of the circulation body to adjust an air volume of the system.

In accordance with certain aspects of the present disclosure, the method can include positioning the array of apertures circumferentially along the knob in a spiral.

In accordance with certain aspects of the present disclosure, the knob can include an outer knob comprising the array of apertures coupled to and selectively aligned with an inner knob with a second array of apertures, the inner knob nested in the outer knob. In certain aspects, the method can include securely engaging the inner knob with the outer knob so that the array of apertures of the outer knob is aligned with an array of apertures of the inner knob.

In accordance with certain aspects of the present disclosure, the step of only permitting intake of air, during inhalation from the mouthpiece, can include directing air through the at least one aperture of the outer knob, at least one aperture of the inner knob, and the intake aperture of the circulation body.

To the accomplishment of the foregoing and related ends, certain illustrative aspects are described herein in connection with the following description and the appended drawings. These aspects are indicative, however, of but a few of the various ways in which the principles of the claimed subject matter can be employed and the claimed subject matter is intended to include all such aspects and their equivalents. Other advantages and novel features can become apparent from the following detailed description when considered in conjunction with the drawings.

BRIEF DESCRIPTION OF THE DRAWINGS

The above and further aspects of this disclosure are further discussed with reference to the following description in conjunction with the accompanying drawings, in which like numerals indicate like structural elements and features in various figures. The drawings are not necessarily to scale, emphasis instead being placed upon illustrating principles of the invention. The figures depict one or more implementations of the inventive devices, by way of example only, not by way of limitation.

FIGS. 18A-18C depict perspective views of a main body of the oxygen trainer assembly of FIGS. 11A-11B;

DETAILED DESCRIPTION

Figure 1A:
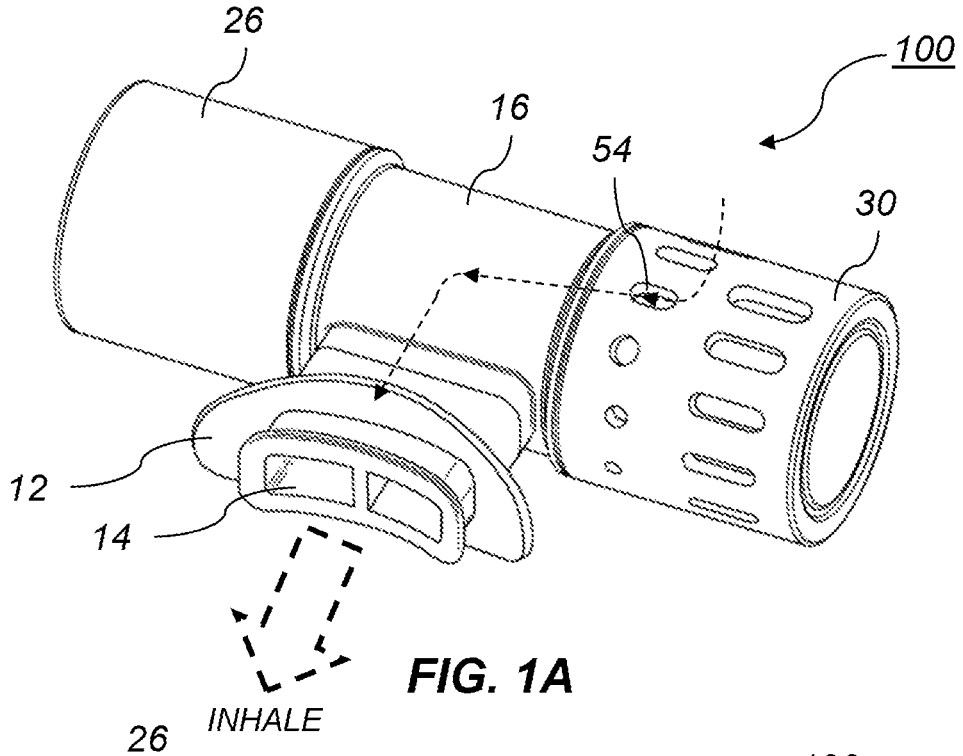
FIG. 1A depicts a perspective view of the oxygen trainer assembly during inhalation.

Although example embodiments of the disclosed technology are explained in detail herein, it is to be understood that other embodiments are contemplated. Accordingly, it is not intended that the disclosed technology be limited in its scope to the details of construction and arrangement of components set forth in the following description or illustrated in the drawings. The disclosed technology is capable of other embodiments and of being practiced or carried out in various ways.

The terms "distal" or "proximal" are used in the following description with respect to a position or direction relative to the treating physician. "Distal" or "distally" are a position distant from or in a direction away from the physician. "Proximal" or "proximally" or "proximate" are a position near or in a direction toward the physician.

It must also be noted that, as used in the specification and the appended claims, the singular forms "a," "an" and "the" include plural referents unless the context clearly dictates otherwise. By "comprising" or "containing" or "including" it is meant that at least the named compound, element, particle, or method step is present in the composition or article or method, but does not exclude the presence of other compounds, materials, particles, method steps, even if the other such compounds, material, particles, method steps have the same function as what is named.

As used herein, the terms "about" or "approximately" for any numerical values or ranges indicate a suitable dimensional tolerance that allows the part or collection of components to function for its intended purpose as described herein. More specifically, "about" or "approximately" can refer to the range of values±10% of the recited value, e.g. "about 90%" can refer to the range of values from 81% to 99%. In addition, as used herein, the terms "patient," "host," "user," and "subject" refer to any human or animal subject and are not intended to limit the systems or methods to human use, although use of the subject invention in a human patient represents a preferred embodiment.

In describing example embodiments, terminology will be resorted to for the sake of clarity. It is intended that each term contemplates its broadest meaning as understood by those skilled in the art and includes all technical equivalents that operate in a similar manner to accomplish a similar purpose. It is also to be understood that the mention of one or more steps of a method does not preclude the presence of additional method steps or intervening method steps between those steps expressly identified. Steps of a method can be performed in a different order than those described herein without departing from the scope of the disclosed technology. Similarly, it is also to be understood that the mention of one or more components in a device or system does not preclude the presence of additional components or intervening components between those components expressly identified.

Figure 1B:
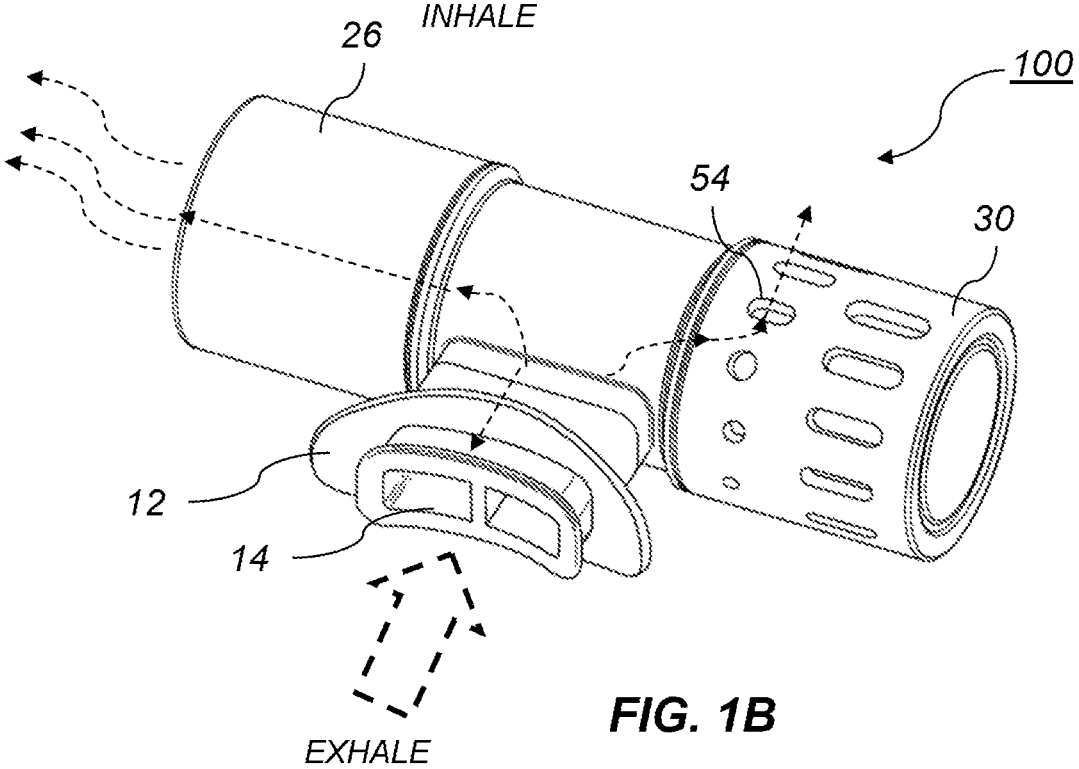
FIG. 1B depicts a perspective view of the oxygen trainer assembly of FIG. 1A during exhalation.
Figure 2A:
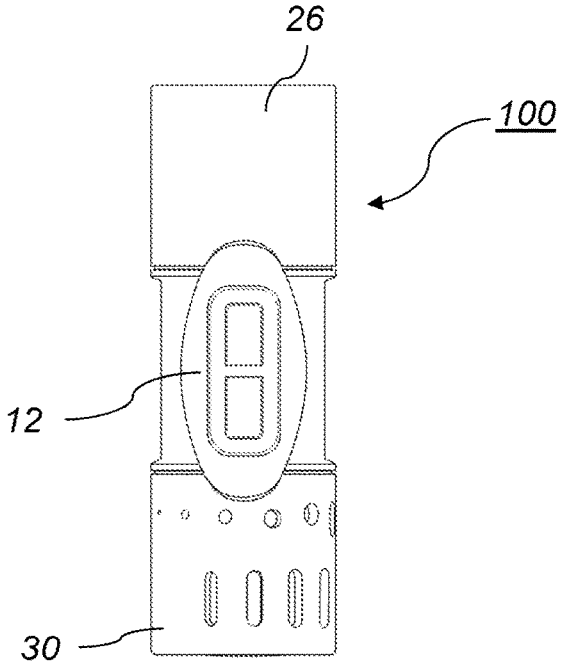
FIG. 2A depicts a front plan view of the oxygen trainer assembly of FIGS. 1A and 1B.
Figure 2B:
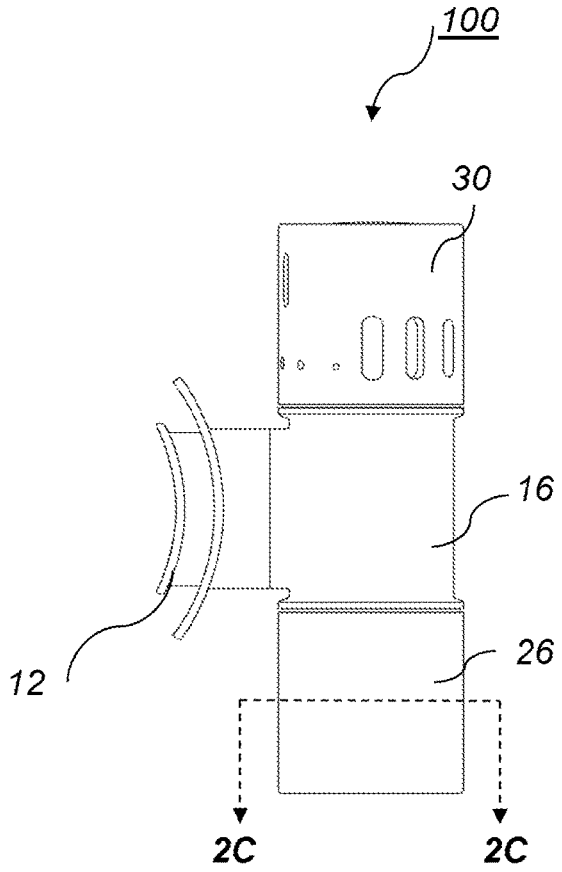
FIG. 2B depicts a top plan view of the oxygen trainer assembly of FIGS. 1A and 1B.
Figure 3A:
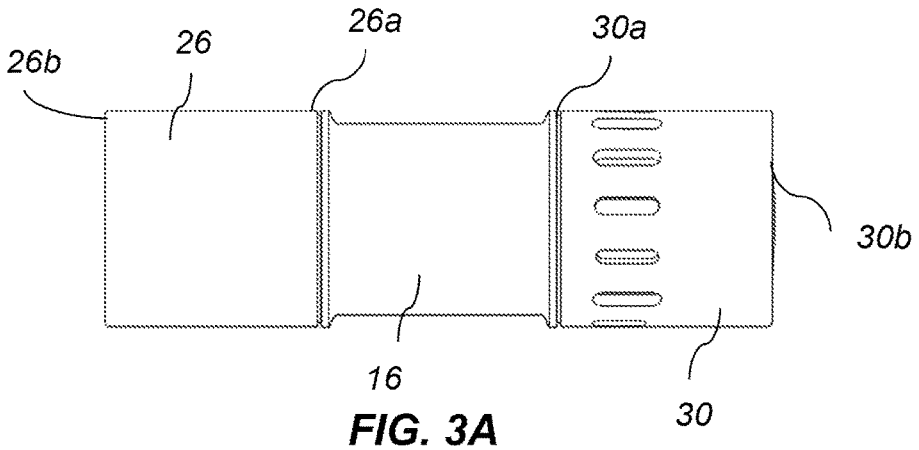
FIG. 3A depicts a lower plan view of the oxygen trainer assembly of FIGS. 1A and 1B.
Figure 3B:
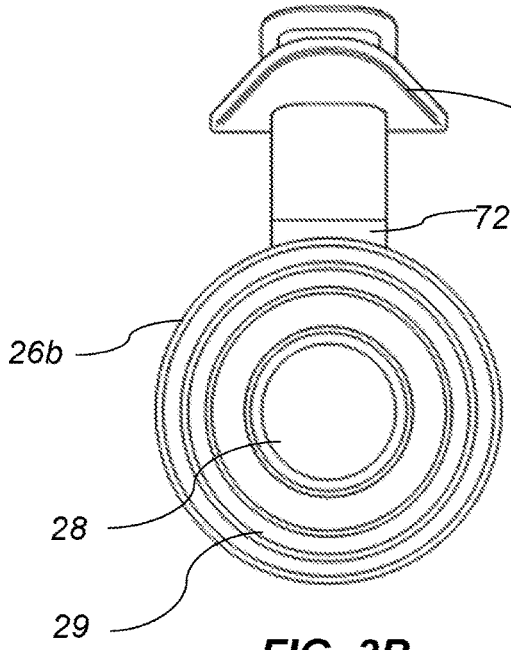
FIGS. 3B-3C depicts side plan views of the oxygen trainer assembly of FIGS. 1A and 1B.
Figure 3C:
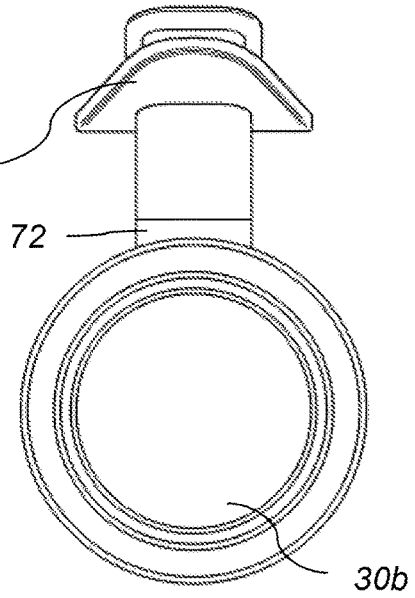
Figure 4:
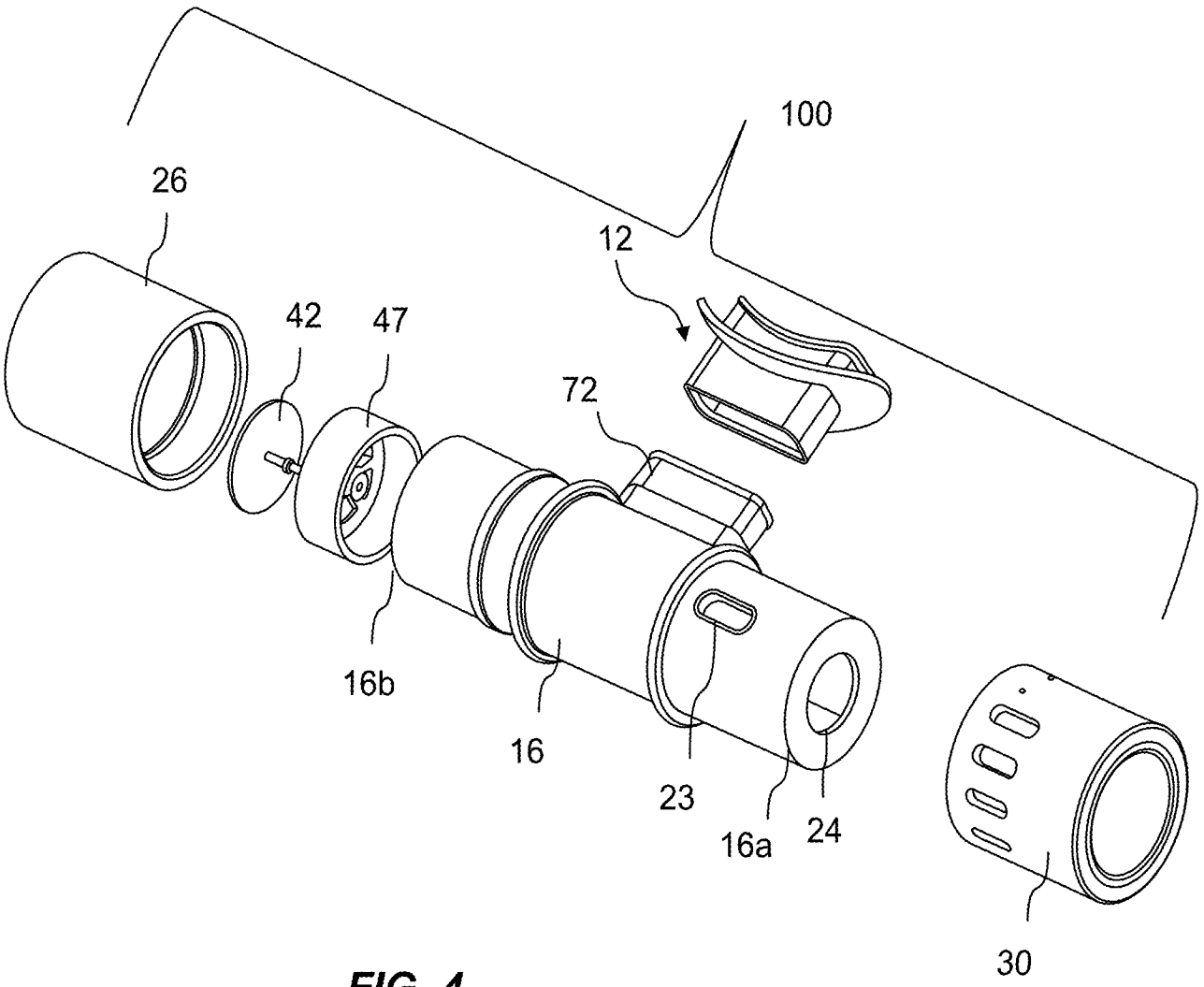
FIG. 4 depicts an exploded perspective view of the oxygen trainer assembly of FIGS. 1A and 1B.

Specific embodiments of the present disclosure are now described in detail with reference to the figures, wherein identical reference numbers indicate identical or functionally similar elements. Turning to FIGS. 1A-1B, one example oxygen trainer assembly 100 is shown. In particular, FIG. 1A depicts a perspective view of the oxygen trainer assembly 100 in accordance with certain aspects with an exemplary air flow path during inhalation. FIG. 1B shows a perspective view of assembly 100 with an exemplary air flow path during exhalation. FIG. 2A shows a front plan view of assembly 100 while FIG. 2B shows a top plan view of assembly 100. FIG. 3A shows a rear plan view of assembly 100. FIG. 3B and FIG. 3C show side plan views of assembly 100. FIG. 4 shows an exploded upper perspective view of assembly 100 and FIG. 5 shows an exploded lower perspective view of assembly 100.

Figure 5:
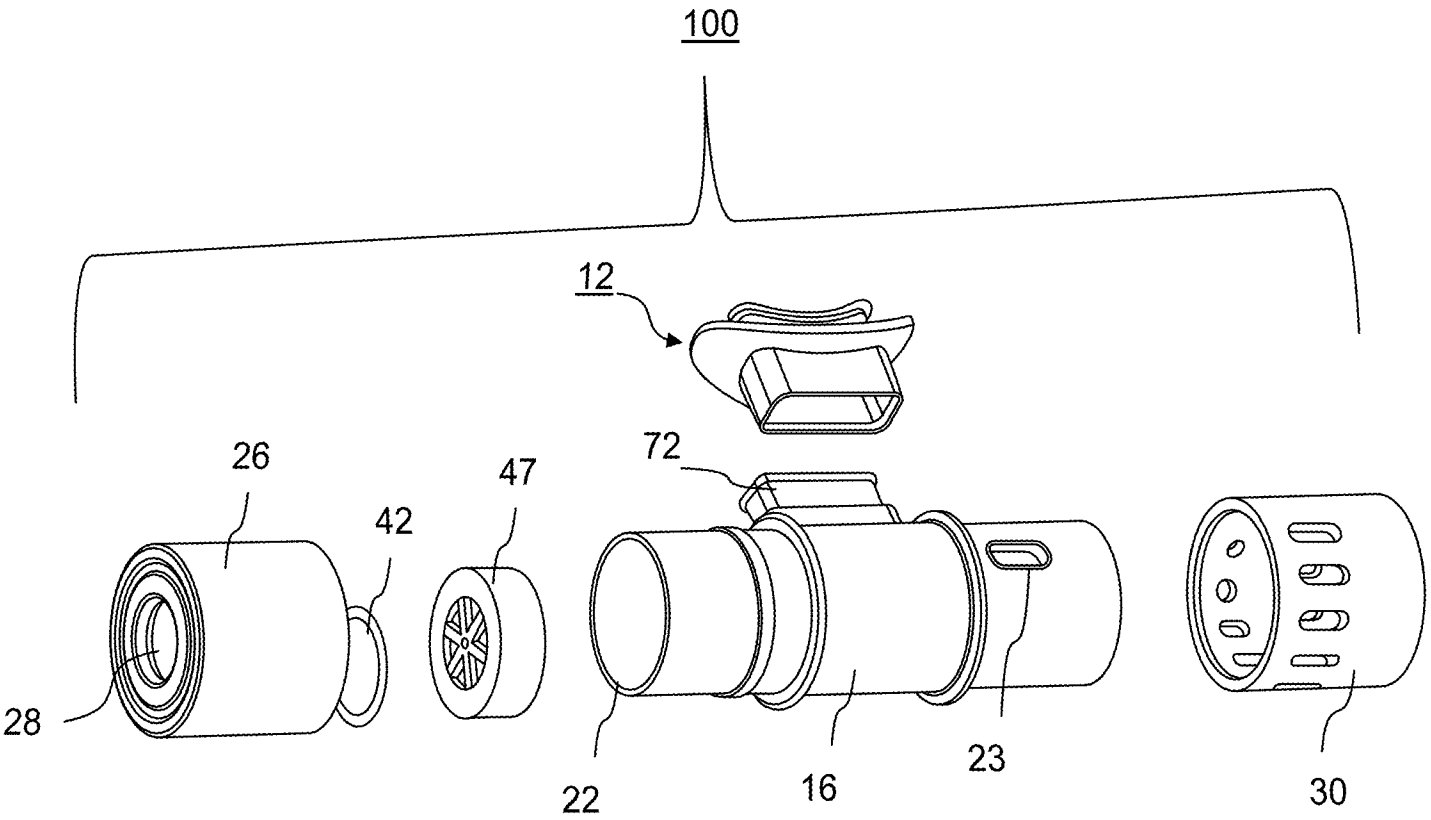
FIG. 5 depicts an exploded perspective view of the oxygen trainer assembly of FIGS. 1A and 1B.

As shown in FIGS. 4-5, assembly 100 can be formed by assembling valve cover 26 with a one-way disc valve 42, and a valve seat 47 on an end 16*b* of a main circulation body 16. A volume knob 30 can be assembled to an opposite end 16*a* of body 16. A detachable mouthpiece 12 can be mounted between ends 16*a*, 16*b* on a mouthpiece receiver 72, which can be in fluid communication and extend from an inner lumen of body 16. In some aspects, receiver 72 can be orthogonal to a longitudinal axis of body 16.

Figure 6A:
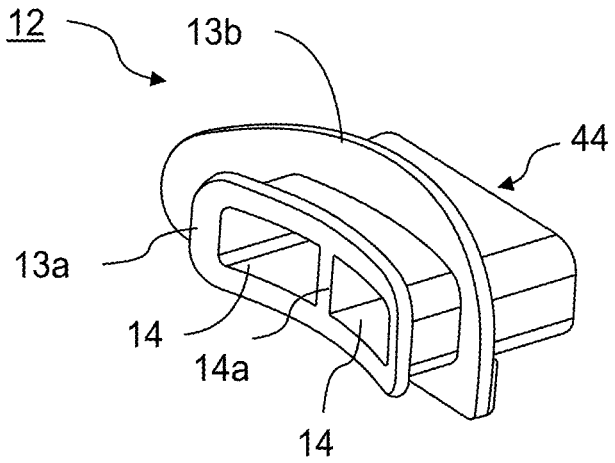
FIG. 6A-6B depict a perspective views of an example mouthpiece of the oxygen trainer assembly of FIGS. 1A and 1B.
Figure 6B:
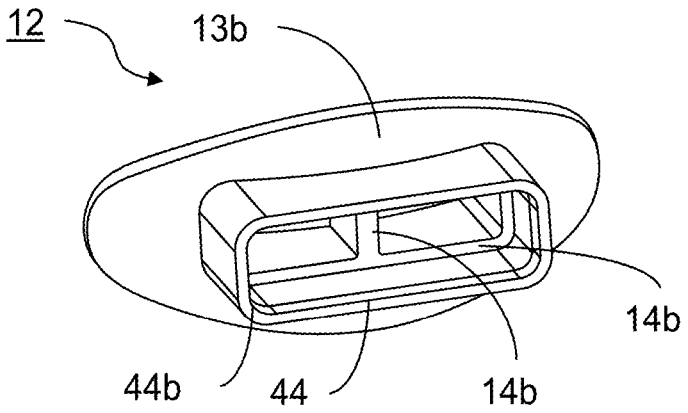
Figure 7A:
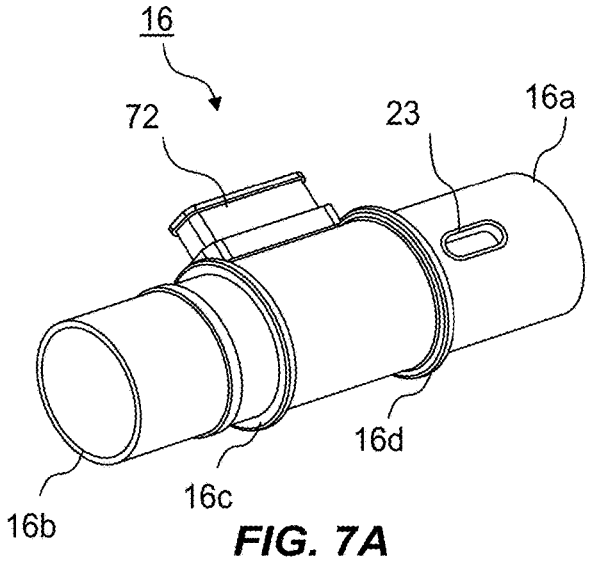
FIGS. 7A-7C depict perspective views of a main body of the oxygen trainer assembly of FIGS. 1A and 1B.
Figure 7B:
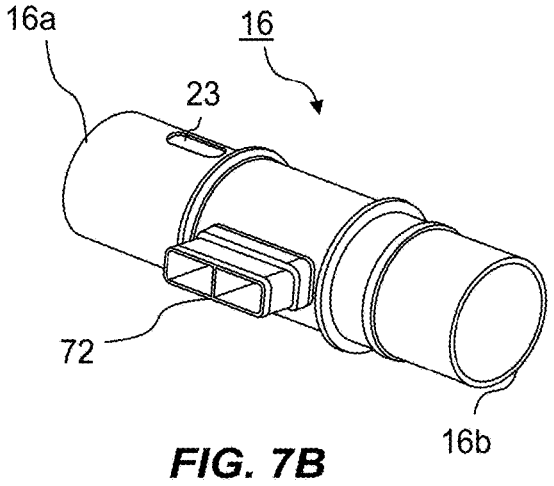
Figure 7C:
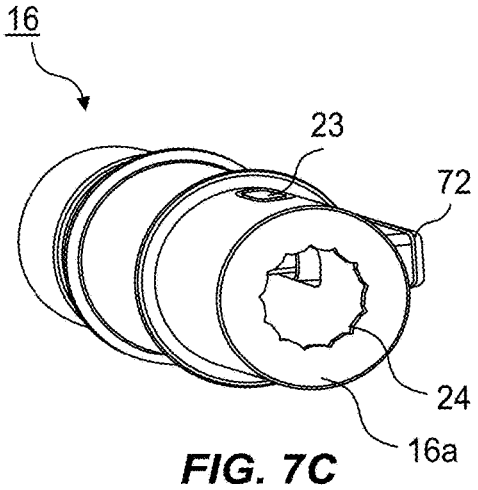
Figure 8A:
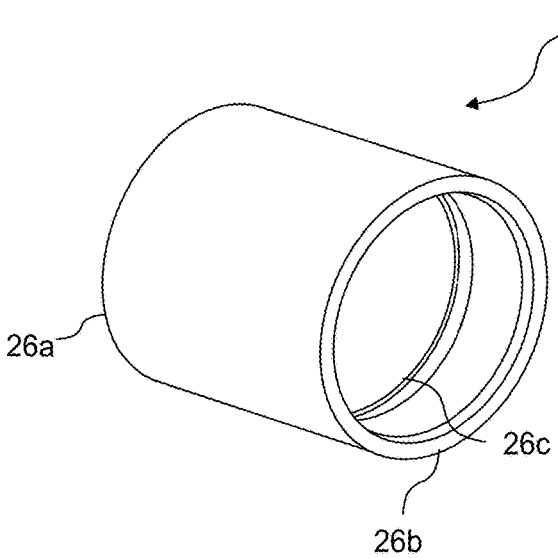
FIGS. 8A-8B depict perspective views of a valve cover of the oxygen trainer assembly of FIGS. 1A and 1B.
Figure 8B:
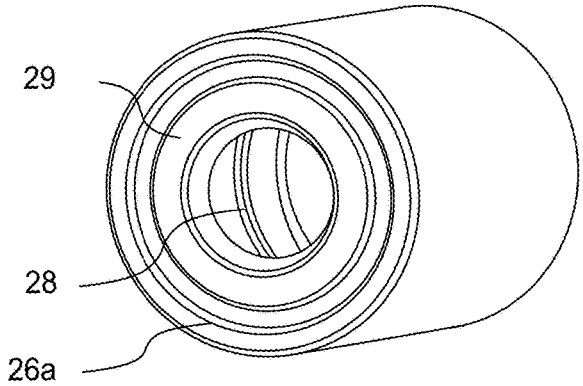
Figure 8C:
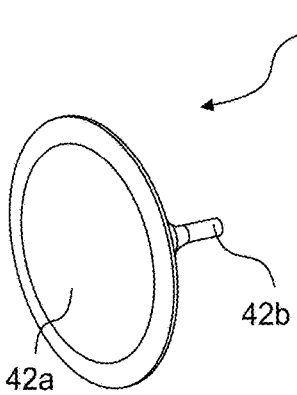
FIGS. 8C-8D depicts perspective views of a valve of the oxygen trainer assembly of FIGS. 1A and 1B.
Figure 8D:
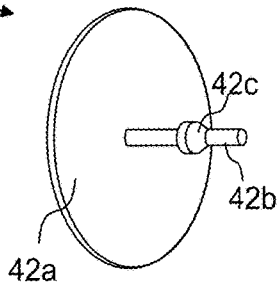
Figure 9A:
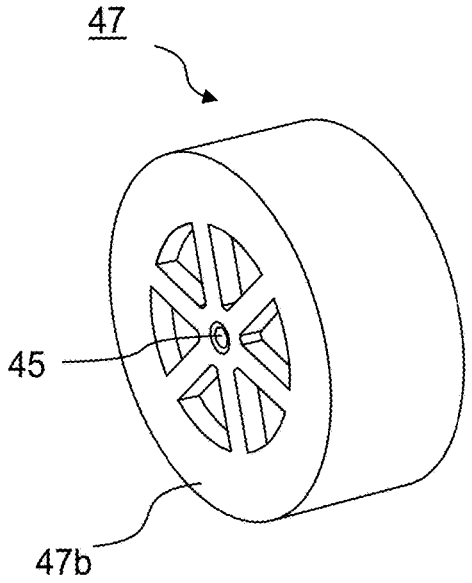
FIGS. 9A-9B depict perspective views of a valve seat of the oxygen trainer assembly of FIGS. 1A and 1B.
Figure 9B:
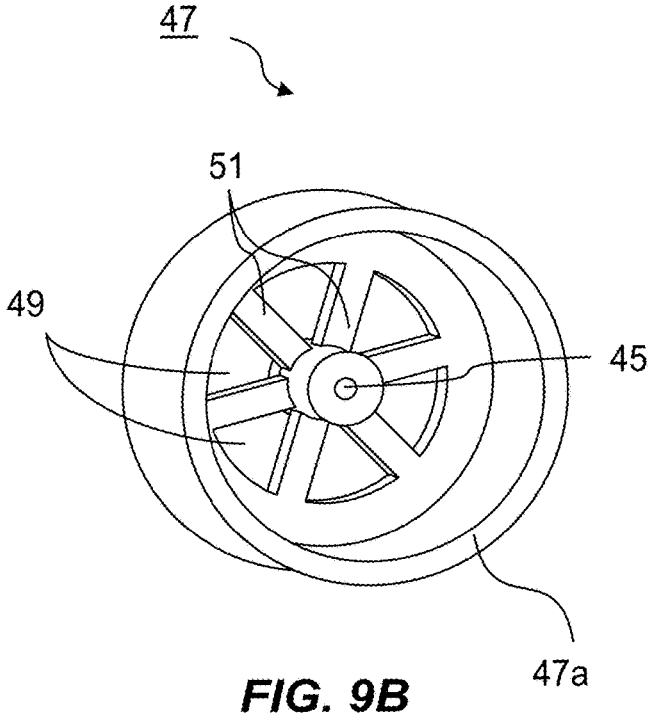

Mouthpiece 12 is further described and shown in FIG. 6A and FIG. 6B. FIG. 6A shows a forward perspective view of mouthpiece 12 while FIG. 6B shows a rear perspective view of example mouthpiece 12. As shown, mouthpiece 12 can be detachable from body 16 and include a mouthpiece channel 44 mountable to body 16, as shown assembled therewith in FIGS. 1A-1B. Mouthpiece 12 being detachable is advantageous since it can be easily replaced and/or conveniently cleaned so as to be maintained in a hygienic condition thereby reducing the transmission of germs therethrough. Mouthpiece 12 can include an opening 14 proximate the mouthpiece channel 44.

A forward flange 13*a* can be provided surrounding opening 14 and configured so that a user can comfortably rest their teeth thereabouts. A larger, principle flange 13*b* can be positioned distal of flange 13*a*. The space formed between flanges 13*a*, 13*b* can be configured so that a user can rest their teeth, lips, and/or the like during use while inhaling air through opening 14. A partition 14*a* can be provided that runs from flange 13*a* distal towards channel 44. Channel 44 can extend distally from the side 14*b* where partition 14*a* and/or walls of opening 14 terminate so as to leave an internal recess or step. The step defined between side 44*b* and side 14*b* can be configured to couple (e.g., form a friction fit) with a corresponding mouthpiece receiver 72, which can have a fluid port running therethrough to provide fluid communication between mouthpiece 12 and one or more inner lumens of body 16. In some aspects, assembly 100 can include multiple different mouthpieces 12. For example, assembly 100 can include a first mouthpiece 12 configured for working out and a second mouthpiece 12 configured for breathing exercises. However, the solution is not so limited and additional mouthpieces are contemplated for use as needed or required Turning back to FIGS. 1A-1B, assembly 100 may have a main circulation body 16 with a circulation chamber disposed within walls of body 16 which in an assembled state, is in fluid communication with the mouthpiece opening 14 via receiver 72. Aspects of body 16 are further described and shown in FIGS. 7A to 7C. As can be seen in FIGS. 1A-1B and FIGS. 7A-7C, body 16 can may have a first end 16*a* opposite and a second end 16*b*. End 16A can include a circulation aperture 24 formed in walls of end 16A. Aperture 24 can include a diameter smaller than an outer diameter of body 16. While body 16 is shown with tubular walls, body 16 is not so limited and can included any shape, as needed or required (e.g., rectangular, triangular, etc.). An outer circulation aperture 23 can be positioned between end 16A and receiver 72. Receiver 72 can protrude from a central portion of body 16 with a channel configured to receive a corresponding mouthpiece channel 44 of mouthpiece 12. Between receiver 72 and end 16*b*, a stop 16*c* can be provided configured to receive a proximate end 26*b* of a valve cover 26. Stop 16*c* can be a protrusion radially outward entirely around body 16 or can be one or more radial protrusions configured to prevent cover 26 from advancing therepast once assembled over end 16*b*.

Assembly 100 may have a valve cover 26 mountable to end 16*b*, which can include a substantially tubular shape with an open end, as shown in FIGS. 1A to 1B. Cover 26 is more particularly shown in FIGS. 4, 5, 8A and 8B, which include perspective views of cover 26. Cover 26 can include an open end 26*b* configured to receive a valve 42. Valve 42 can be a one-way valve. Air that is prevented passing by valve 42 during inhalation, as shown in FIGS. 1A, can be exhaled by the end-user through valve 42 from within body 16 by overcoming an air resistance of valve 42, as discussed more particularly below.

A step 26*c* can be positioned proximate end 26*b* but within an inner lumen of cover 26. Step 26*c* can be configured to securely engage with valve 42. Cover 26 may have a valve aperture 28 formed on or about end 26*a*, opposite end 26*b*. Aperture 28 can be formed in a flexible wall 29. In the assembled state of FIGS. 1A to 1B, aperture 28 can be in fluid communication with the opening of end 16*b* and valve 42 can be positioned within cover 26 securely engaged with step 26*c*. An outer diameter of valve 42 can be configured to snugly fit within an inner diameter of cover 26 and step 26*c* can have an inner diameter smaller than valve 42 so as to prevent being advanced therepast towards end 26*a*.

Figure 2C:
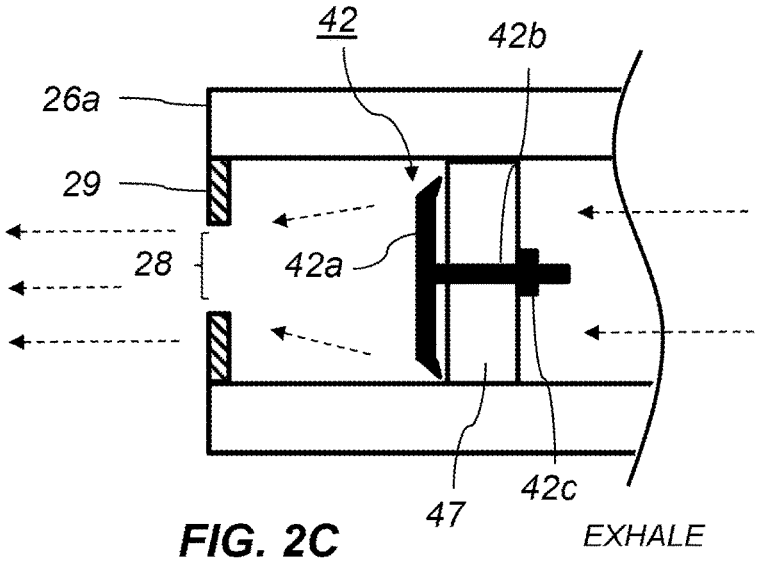
FIG. 2C depicts is a cross-sectional view of section 2C-2C of FIG. 2B.

Valve 42 is more particularly shown in FIGS. 4, 5, 8C and 8D as well as in its assembled state in FIG. 2C during exhalation, which is a side cross-section view of assembly 100 at section 2C-2C of FIG. 2B. Valve 42 can include a disk 42*a*, which can be flexible (e.g., formed of an elastomer such as rubber) so as to permit fluid only and/or exclusively in one direction (e.g., exhalation) while closing in a seal state (e.g., inhalation) to prevent flow. In some aspects, the outer perimetral edge of disk 42*a* can be thinner than other portions of disk 42*a* so as to facilitate opening or closing of valve 42 during use. A rod like member 42*b* can extend from a central portion of disk 42*a* with a thicker rod portion 42*c* centrally located on member 42*b*. The outer diameter of disk 42*a* is configured to engage valve seat 47 with a diameter less than an inner diameter of cover 26. Valve seat 47 is more particularly shown in FIGS. 4, 5, 9A, and 9B.

In particular, valve seat 47 can include an open end 47*a* and an end 47*b* opposite therewith. One or more walls can extend between ends 47*a*, 47*b*. A central alignment aperture 45 can extend through end 47*b* with one or more strut members 51 radially extended between aperture 45 and end 47*b*. Portion 42*c* and member 42*b* of valve 42 can coupled with seat 47, as shown in FIG. 2C in an assembled state. One or more gaps 49 can be formed between members 51 configured to permit air flow therethrough. Gap(s) 49 can be defined with a diameter less than a diameter of disc 42*a*. In this respect, during inhalation, disk 42*a* can and/or will provide a complete resistance to the passage of airflow by sealing against end 47*b* of valve seat 47 and thus aperture 28 caused by a sealing or blockage between disc 42*a* and valve seat 47. In contrast, during exhalation disc 42*a* can and/or will move away from seat 47 so as to permit egress of air from body 16 through seat 47 and ultimately aperture 28.

Figure 10A:
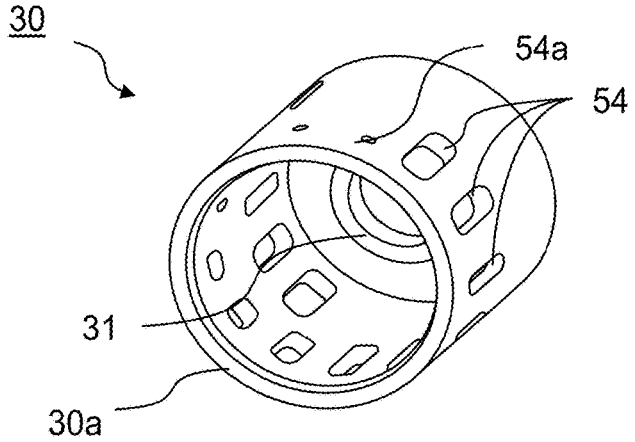
FIGS. 10A-10C depicts perspective views of a volume knob of the oxygen trainer assembly of FIGS. 1A and 1B.
Figure 10B:
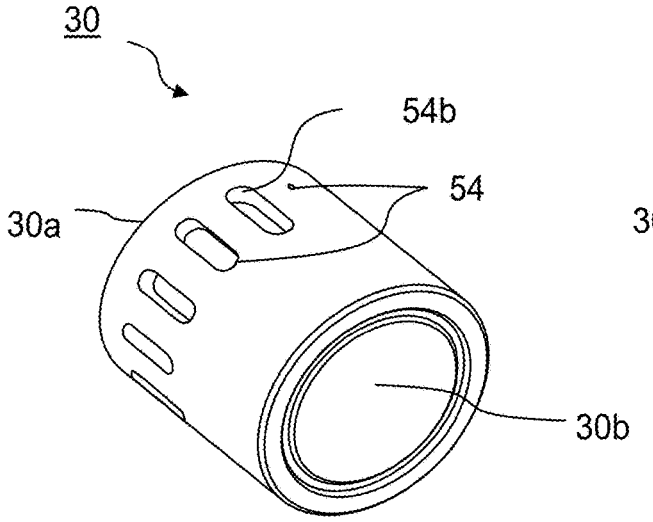
Figure 10C:
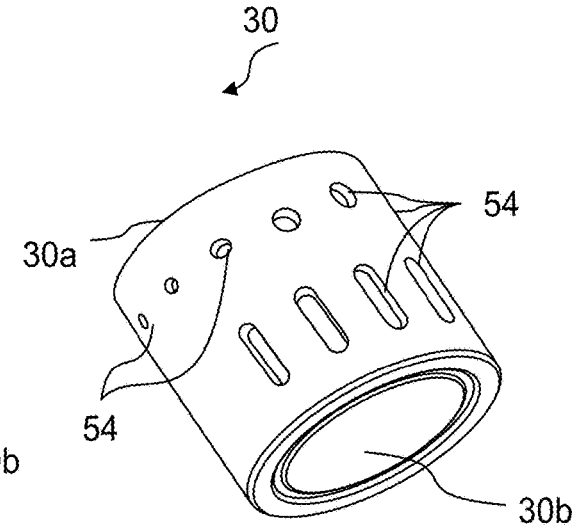

Turning back to FIGS. 1A and 1B, assembly 100 can include a volume knob 30 mountable to end 16*a*. In particularly, between receiver 72 and end 16*a*, a stop 16*d* can be provided configured to receive a proximate end 30*b* of knob 30. Similar to stop 16*c*, stop 16*d* can be a protrusion radially outward entirely around body 16 or can be one or more radial protrusions configured to prevent knob 30 from advancing therepast once assembled over end 16*a*. Knob 30 is more particularly shown in FIGS. 10A to 10C, which include perspective views of knob 30. Knob 30 can include an open end 30*a* opposite end 30*b*. Knob 30 can include an array of circulation apertures 54 of varying size and/or shape. In some aspects, apertures 54 can circumferentially wrap around and extend between outer and inner surfaces of knob 30. In some aspects, the size and/or shape of each aperture 54 can vary from smallest to largest, or vice versa, so that rotating knob 30, once assembled with end 16*a*, can cause a respective aperture 54 of the array of apertures 54 to orient and couple with aperture 23 of body 16. In so doing, rotating knob 30 between one or more orientations can allow for end user(s) to easily and precisely adjust air volume and levels of air resistance associated with assembly 100 thereby improving a user's inspiratory muscular endurance during use.

For example, if an end user is desirous of having a greatest air resistance of assembly 100 during inhalation and/or exhalation, then the smallest aperture (e.g., aperture 54*a* in FIG. 10A) can be oriented so as to couple and/or radially align with aperture 23 by rotating assembled knob 30. Similarly, if an end user is desirous of having a lowest level of air resistance in assembly 100 during inhalation (e.g., see flow path in FIG. 1A) and/or exhalation (e.g., see flow path in FIG. 1B), then the largest aperture (e.g., aperture 54*b* of FIG. 10B) of the array of apertures 54 can be oriented so as to couple and/or radially align with aperture 23 by rotating assembled knob 30. The size of aperture 54 and its orientation with respect to aperture 23 can therefore control the level of air resistance of assembly 100 during inhalation and exhalation. In some examples, the diameter of apertures 54 can range from approximately 1 mm and approximately 8 mm and signify an approximate air volume equivalent of assembly 100 and/or resistance. It is contemplated that the apertures 54 can have larger or smaller diameters or include different shapes than those depicted, as needed or required.

Adjacent each aperture 54, optionally a label or demarcation can be provided to inform an end-user the related resistance of a respective aperture 54. For example, an end-user can rotate knob 30 in a throttle like manner and precisely control resistance and/or air volume of assembly 100 by monitoring the respective label of each aperture 54. This increased air resistance upon inhalation for air circulating through apertures 54 and 23 into body 16 is particularly advantageous to increase a user's aspiratory and inspiratory muscular endurance. In this respect, the end user can adjust the air level resistance of assembly 100 by rotating an assembled knob 30 between apertures of the array of apertures 54 there positioned, during inhalation and out of the inner lumen chamber of body 16 during exhalation. This is particularly advantageous for end users because it provides a precise manner in which to adjust between easier, intermediate, and more advanced settings of aspiratory muscular endurance training by enabling precise control of resistance during inhalation and exhalation.

In some aspects, as knob 30 is rotated in a throttle like manner to orient aperture(s) 54 with respect to aperture 23, knob 30 can rotate away from or deeper into body 16. This movement between knob 30 and body 16 can cause an internal air volume of assembly 100 to adjust between being larger and smaller at least because in certain aspects, the array of apertures 54 can be selectively positioned in a spiral like manner about an outer surface of seat. In rotating knob 30 in this throttle like manner, a total internal air volume of assembly 100 (e.g., the volume enclosed by assembly 100, such as between cover 26, body 16, and knob 30) can therefore be precisely controlled. In the assembled state when end 30*a* of knob 30 is coupled with stop 16*d*, a recess 31 proximate end 30*b* can be configured in fluid communication with aperture 24. In some aspects, air flowing through opening 24 during exhalation can circulate in body 16 and knob 30 before egressing through a respective aperture 54 that is aligned with aperture 23 of body 16.

Figure 11A:
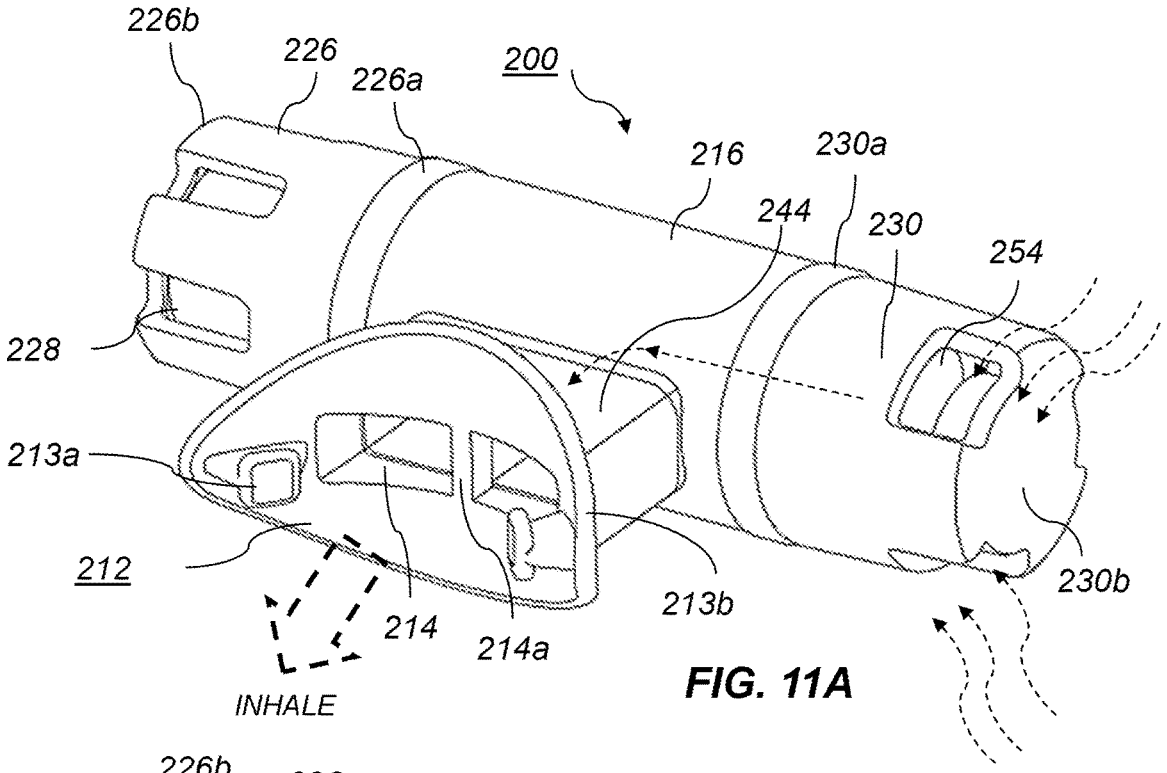
FIG. 11A depicts a perspective view of another example oxygen trainer assembly during inhalation.
Figure 11B:
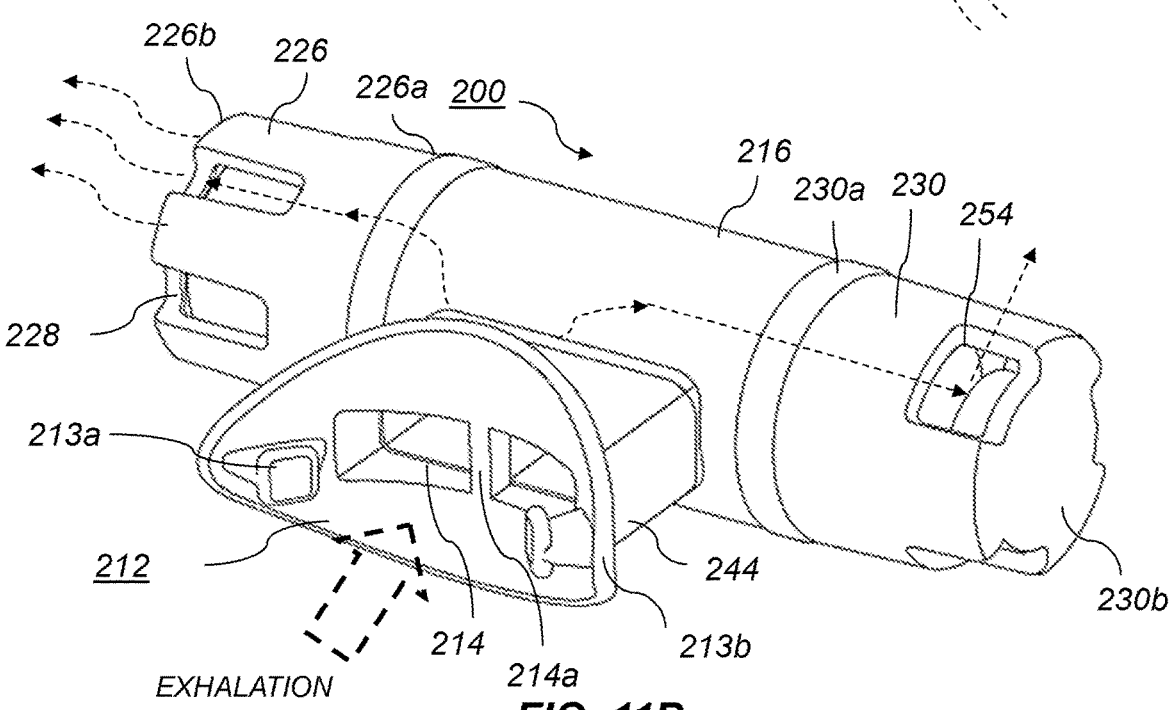
FIG. 11B depicts a perspective view of the oxygen trainer assembly of FIG. 11B during exhalation.
Figure 12A:
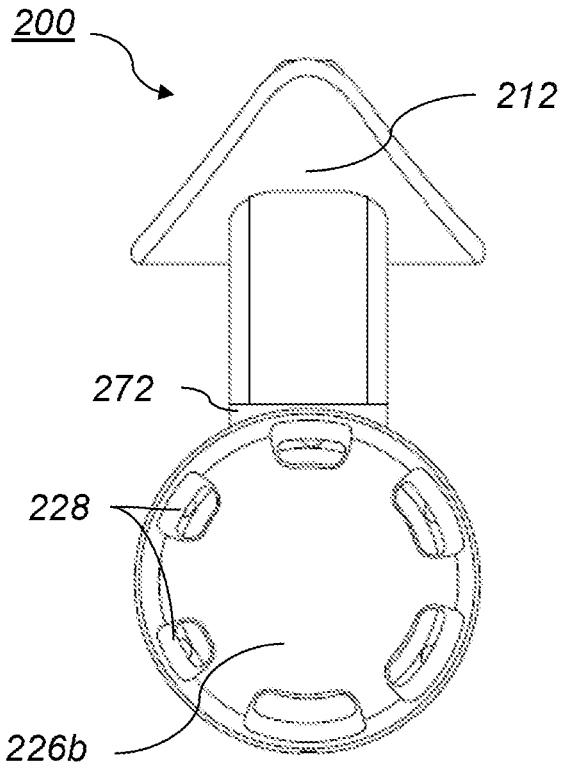
FIGS. 12A-12B depicts side plan views of the oxygen trainer assembly of FIGS. 11A-11B.
Figure 12B:
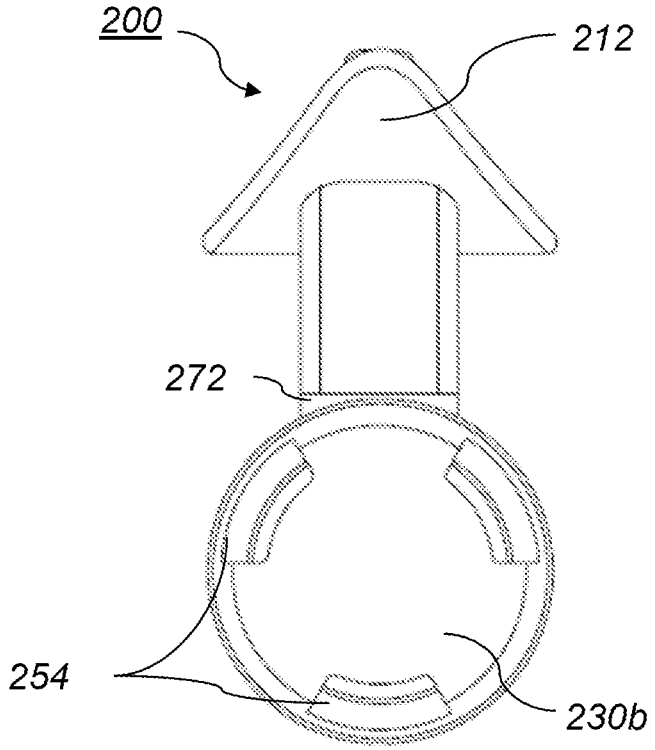
Figure 13A:
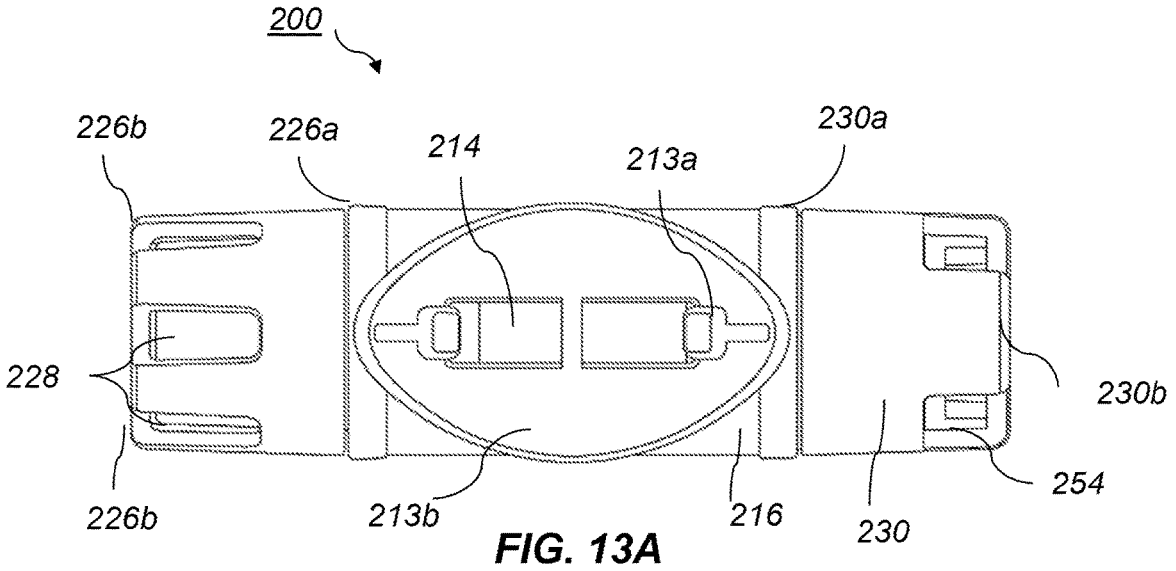
FIGS. 13A-13B are front and rear plan views of the oxygen trainer assembly of FIGS. 11A-11B, respectively.
Figure 13B:
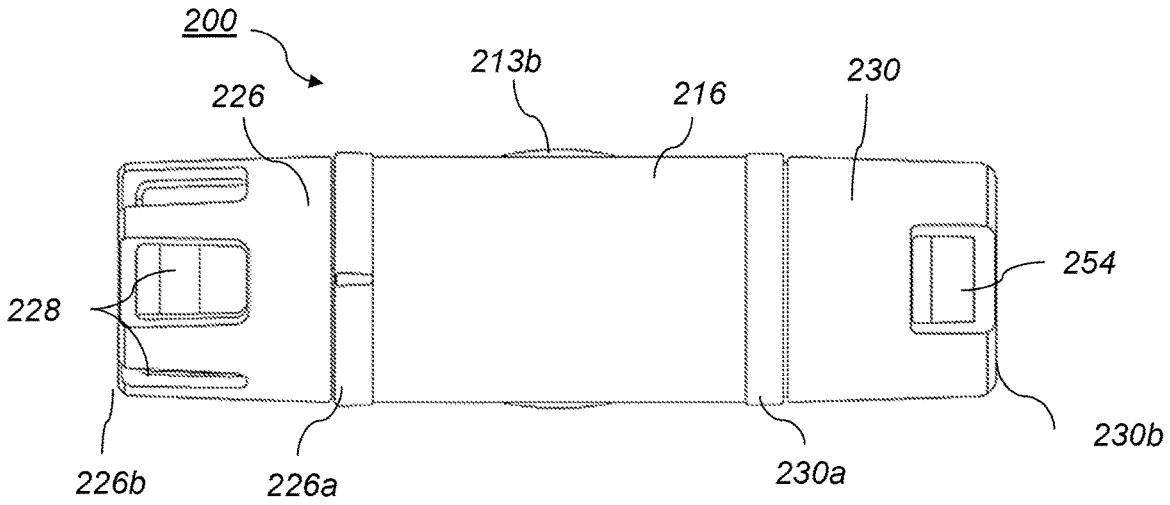
Figure 14:
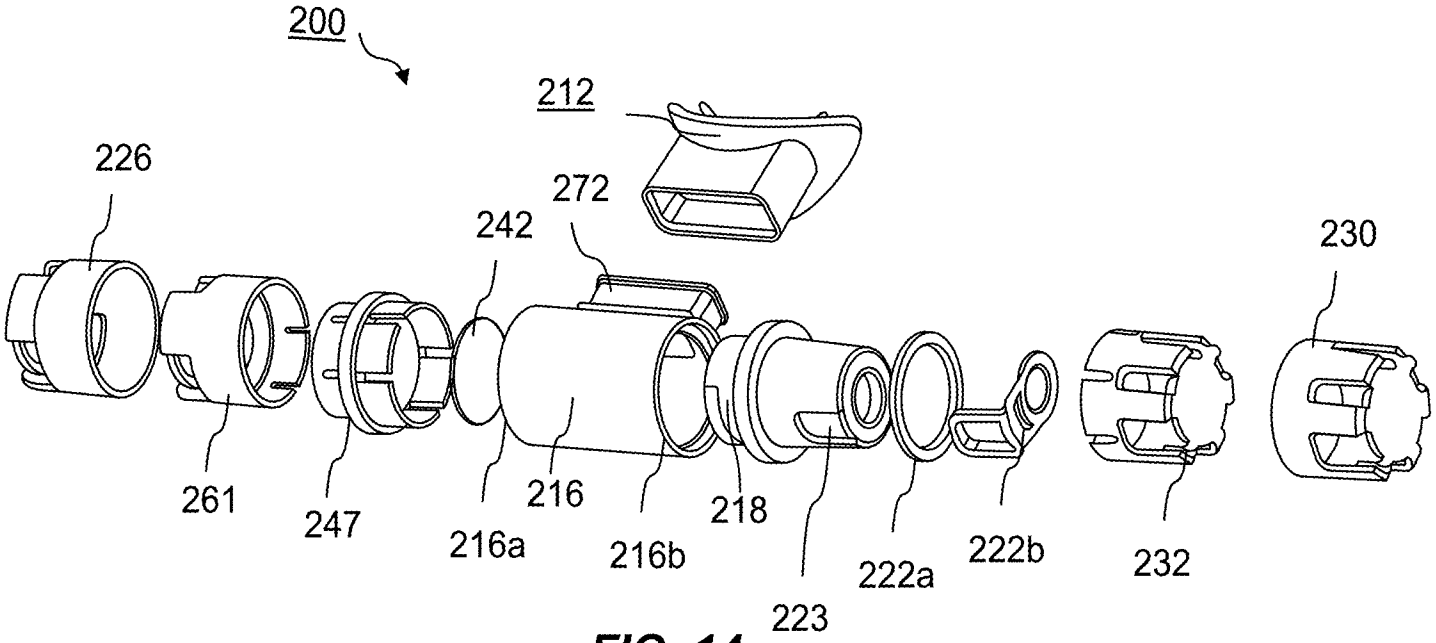
FIGS. 14-15 depict exploded perspective views of the oxygen trainer assembly of FIGS. 11A-11B.

Turning to FIGS. 11A-11B, another example oxygen trainer assembly 200 is shown. In particular, FIG. 11A depicts a perspective view of the oxygen trainer assembly 200 in accordance with certain aspects with an exemplary air flow path during inhalation. FIG. 11B shows a perspective view of assembly 200 with an exemplary air flow path during exhalation. FIG. 12A and FIG. 12B show side plan views of assembly 200. FIG. 13A shows a front plan view of assembly 200 while FIG. 13B shows a rear plan view of assembly 200. FIG. 14 shows an exploded upper perspective view of assembly 200 and FIG. 15 shows an exploded lower perspective view of assembly 200.

Figure 15:
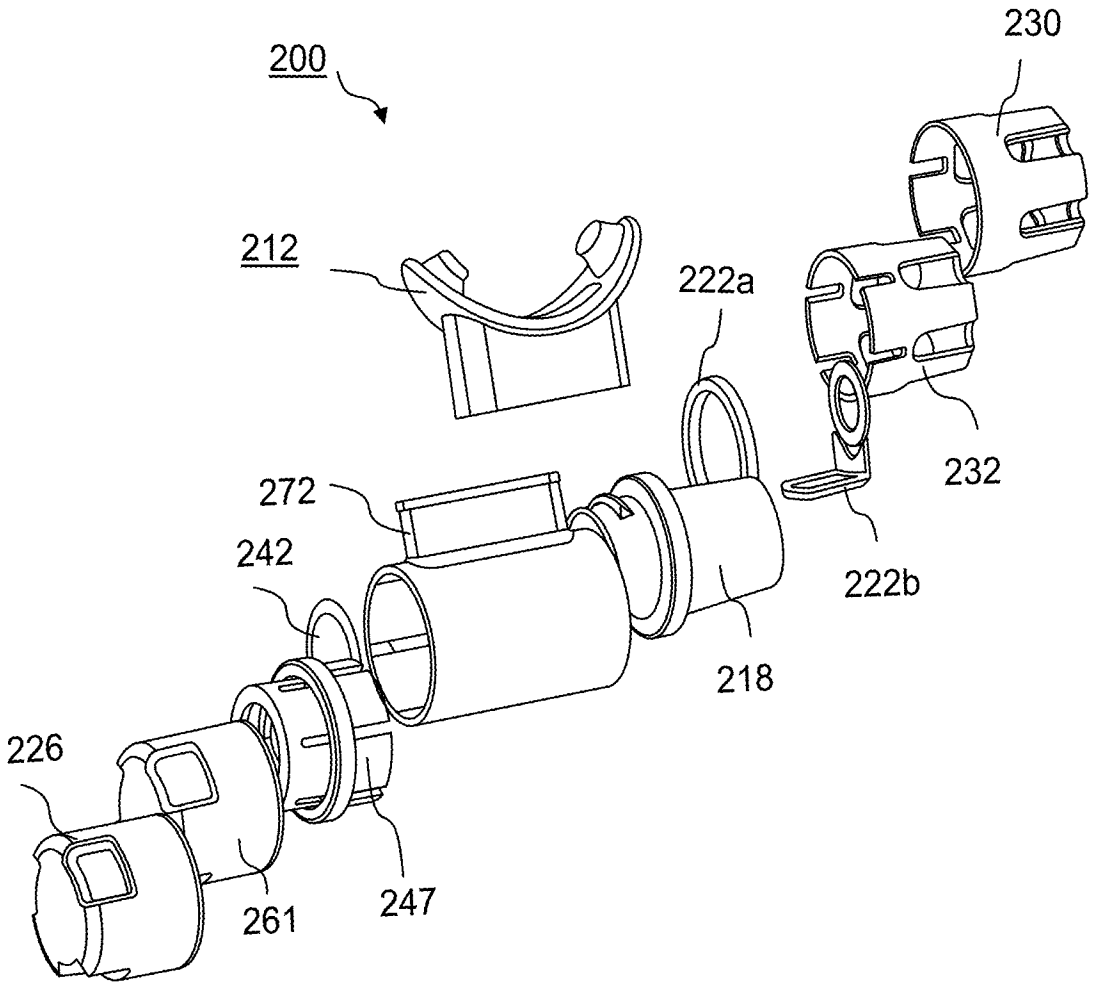

As shown in FIGS. 14-15, assembly 200 can be formed by assembling outer valve cover 226 with an inner valve cover 261, a one-way disc valve 242, and a valve seat 247 on a first end 216*a* of a main circulation body 216. An outer knob 230 can be assembled with an inner knob 232, to a throttle body 218 which can be coupled to an opposite end 216*b* of body 216. A detachable mouthpiece 212 can be mounted between ends 216*a*, 216*b* on a mouthpiece receiver 272, which can be in fluid communication and extend from an inner lumen of body 216. In some aspects, receiver 272 can be orthogonal to a longitudinal axis of body 216.

Figure 17A:
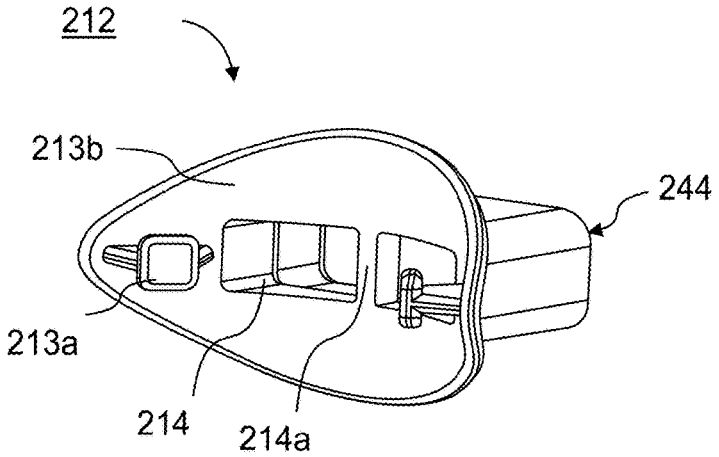
FIGS. 17A-17B depict perspective views of a mouthpiece of the oxygen trainer assembly of FIGS. 11A-11B.
Figure 17B:
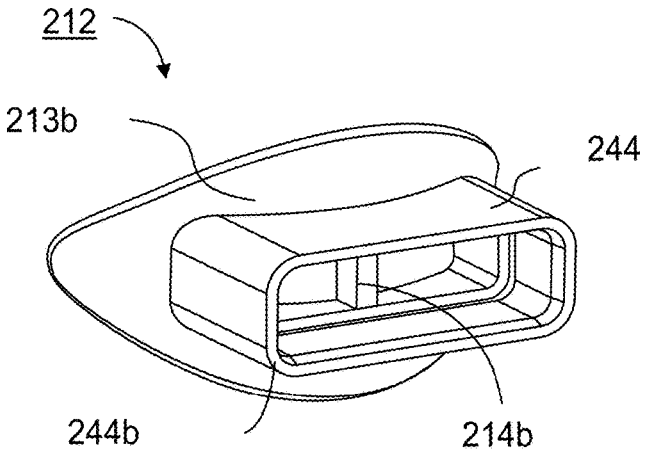

Mouthpiece 212 is further described and shown in FIG. 17A and FIG. 17B. FIG. 17A shows a forward perspective view of mouthpiece 212 while FIG. 17B shows a rear perspective view of example mouthpiece 212. As shown, mouthpiece 212 can be detachable from body 216 and include a mouthpiece channel 244 mountable to body 216, as shown assembled therewith in FIGS. 11A-11B. Mouthpiece 212 being detachable may be advantageous since it can be easily replaced and/or conveniently cleaned so as to be maintained in a hygienic condition thereby reducing the transmission of germs therethrough. Mouthpiece 212 can include an opening 214 proximate the mouthpiece channel 244.

A forward flange post 213*a* can be provided surrounding opening 214 and configured so that a user can comfortably rest their teeth thereabouts. A larger, principle flange 213*b* can be positioned distal of post 213*a*. In some aspects, a pair of opposite posts 213*a* can be provided so that opposite ends of a user's jaw can rest on ports 213*a*. The space formed between posts 213*a* and flange 213*b* can be configured so that a user can rest their teeth, lips, and/or the like during use while inhaling air through opening 214. A partition 214*a* can be provided that runs from post 213*a* distal towards channel 244. Channel 244 can extend distally from the side 214*b* where partition 214*a* and/or walls of opening 214 terminate so as to leave an internal recess or step. The step defined between side 244*b* and side 214*b* can be configured to couple (e.g., form a friction fit) with a corresponding mouthpiece receiver 272, which can have a fluid port running therethrough to provide fluid communication between mouthpiece 212 and one or more inner lumens of body 216. In some aspects, assembly 200 can include multiple different mouthpieces 212. For example, assembly 200 can include a first mouthpiece 212 configured for working out and a second mouthpiece 212 configured for breathing exercises. However, the solution is not so limited and additional mouthpieces are contemplated for use as needed or required Turning back to FIGS. 11A-11B, assembly 200 may have a main circulation body 216 with a circulation chamber disposed within walls of body 216 which in an assembled state, is in fluid communication with the mouthpiece opening 214 via receiver 272. Aspects of body 216 are further described and shown in FIGS. 18A to 18C. As can be seen in FIGS. 11A-11B and FIGS. 18A-18C, body 216 can may have a first end 216*a* opposite and a second end 216*b*.

As further shown in FIG. 14 and FIG. 15, throttle body 218 can be coupled to end 216*a* of body 216. While body 216 is shown with tubular walls, body 216 is not so limited and can included any shape, as needed or required (e.g., rectangular, triangular, etc.). Receiver 272 can protrude from a central portion of body 216 with a channel configured to receive a corresponding mouthpiece channel 244 of mouthpiece 212. Between receiver 272 and end 216*b*, one or more threads can be provided configured to receive a proximate end 226*b* of a valve cover 226. Stop 16*c* can be a protrusion radially outward entirely around body 216 or can be one or more radial protrusions configured to prevent cover 226 from advancing therepast once assembled over end 216*b*.

Figure 21A:
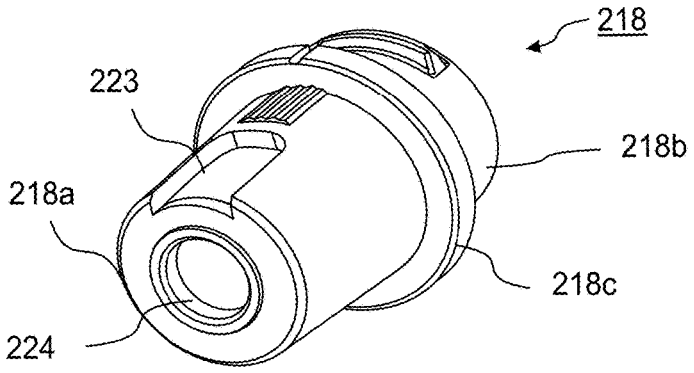
FIGS. 21A-21B depict perspective views of a throttle body of the oxygen trainer assembly of FIGS. 11A-11B.
Figure 21B:
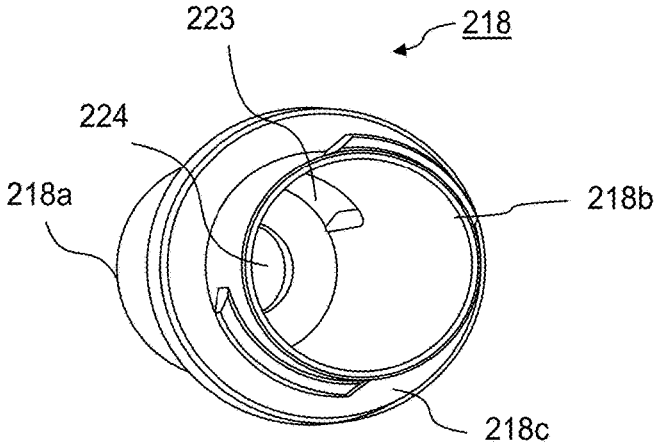

Body 218 is shown more particularly in FIGS. 21A to 21B, which shows perspective views of body 218. Body 218 can include an open end 218*a* which can include one or more threads configured to engage with end 216*a* of body 216. An end 218*b* can be opposite end 218*a* and include a circulation aperture 224 formed in walls thereof. Aperture 224 can include a diameter smaller than an outer diameter of end 218*a* and/or end 218*b*. In some aspects, a larger diameter portion 218*c* can be provided between ends 218*a* and 218*b*. Portion 218*c* can cause body 218 to taper between portion 218*c* to both ends 218*a* and 218*b*. Portion 218*c* can be a thickened portion that circumferentially wraps at least partially around an outer surface of body 218 so as to provide a stop onto which a corresponding end 216*a* can couple on one side and inner 232 and outer 230 knobs can couple on an opposite side thereof. Portion 218*c* can be a protrusion that is oriented radially outward entirely around body 218 or can be one or more radial protrusions configured to prevent knobs 230 and/or 232 from advancing therepast once assembled over at least part of body 218.

Between portion 218*c* and end 218*a*, an outer circulation aperture 223 can be positioned. In some aspects, aperture 223 can be coextensive with end 218. In other examples, aperture 223 can be a window or cutout into an inner lumen of body 218. As can be seen in FIGS. 14 and 15, one or more gaskets or O-rings 222*a* can be provided between portion 218*c* and corresponding knobs 232 and/or 230 so as to form a seal that prevents egress or otherwise leaks air during use. An insert 222*b* may be provided to similarly encourage sealing between aperture 223 and corresponding apertures 254 of knobs 232 and/or 230 during use.

Turning back to FIGS. 11A and 11B, assembly 200 can include outer knob 230 mountable over inner knob 232 so that both knobs 230, 232 can mount to body 218. In particular, knob 232 can assemble over body 218 with body 218 nested therein. Knob 232 is more particularly shown in FIGS. 20C and 20D. Knob 232 can include an open end 232*a* opposite end 232*b* with one or more walls extended therebetween. An array of radially separated notches 232*e* can be positioned on or adjacent end 232*a*. One or more apertures 232*c* can be provided on the walls between ends 232*a* and 232*b*. Apertures 232*c* and be radially arranged about the walls of knob 232 and in some aspects extend from end 232*b* towards notches 232*e*.

Figure 20A:
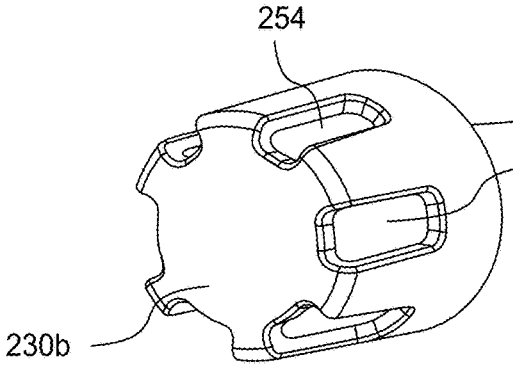
FIGS. 20A-20B depict perspective views of an outer throttle body of the oxygen trainer assembly of FIGS. 11A-11B.
Figure 20B:
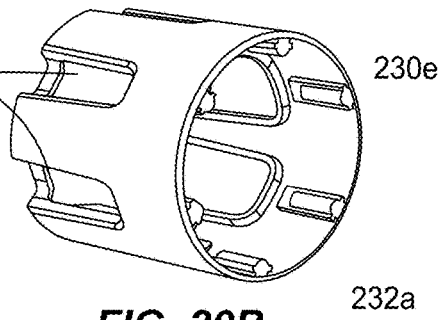
Figure 20C:
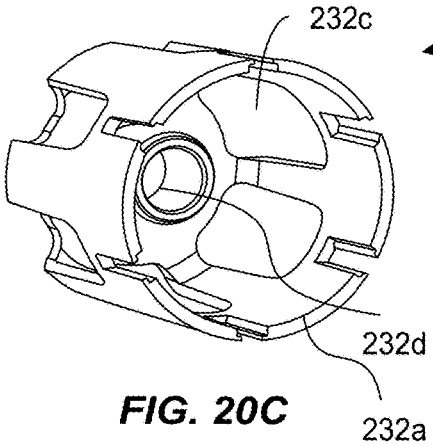
FIGS. 20C-20D depict perspective views of an inner throttle body cap of the oxygen trainer assembly of FIGS. 11A-11B.
Figure 20D:
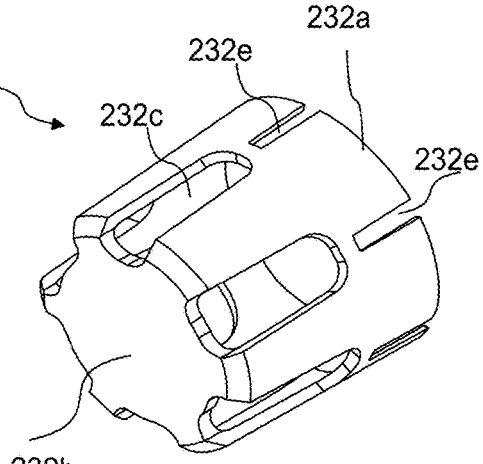

Outer knob 230 is more particularly shown in FIGS. 20A to 20B, which include perspective views of knob 230. Knob 230 can include an open end 230*a* opposite end 230*b*. Knob 230 can include an array of radially arranged circulation apertures 254 of varying size and/or shape. In some aspects, apertures 254 can circumferentially wrap around knob 230 and/or extend between outer and inner surfaces of knob 230. The size and/or shape of each aperture 254 can vary from smallest to largest, or vice versa, so that rotating knob 230, once assembled with inner knob 232, body 218, and end 216*a* of body 216, can cause a respective aperture 254 of the array of apertures 254 to align with a corresponding aperture 232*c* and orient and couple with aperture 223 of body 218.

In some aspects, apertures 254 can extend from end 230*b* towards end 230*a*. An array of radially arranged inward protrusions 230*e* can be provided along an inner surface of knob 230 extended from end 230*a*. Protrusions 230*e* can be sized to couple with corresponding notches 232*e* of knob 232, once knob 230 is assembled over knob 232. Once engaged with each other, rotating knob 230 can also cause 232 to be rotated between one or more orientations and allow for end user(s) to easily and precisely adjust levels of air resistance associated with assembly 200 thereby improving a user's inspiratory muscular endurance during use.

For example, if an end user is desirous of having a greatest air resistance of assembly 200 during inhalation and/or exhalation. The size of apertures 254 and/or 232*c* and respective orientation with respect to aperture 223 of body 218 can therefore control the level of air resistance of assembly 200 during inhalation and exhalation. Similar to apertures 54, the diameter of apertures 254 and/or 232*c* can range between approximately 1 mm and 8 mm and signify an approximate air volume equivalent of assembly 200 and/or resistance. It is contemplated that the apertures 254, 232*c* can have larger or smaller diameters or include different shapes than those depicted, as needed or required.

Adjacent each aperture 254 on an outer surface of assembly 200, optionally a label or demarcation can be provided to inform an end-user the related resistance of a respective aperture 254. For example, an end-user can rotate knob 230 in a throttle like manner and precisely control resistance and/or air volume of assembly 200 by monitoring the respective label of each aperture 254. This increased air resistance upon inhalation for air circulating through apertures 254, 232*c*, and 223 into body 216 is particularly advantageous to increase a user's aspiratory and inspiratory muscular endurance. In this respect, the end-user can adjust the air level resistance of assembly 200 by rotating assembled seats 232, 230 between orientations relative to aperture 223 of body 218, during inhalation and out of the inner lumen chamber of body 216 during exhalation. This is particularly advantageous for end users because it provides a precise manner in which to adjust between easier, intermediate, and more advanced settings of aspiratory muscular endurance training by enabling precise control of resistance during inhalation and exhalation.

In some aspects, as knobs 230, 232 are rotated in a throttle like manner to orient apertures 254, 232*c* with respect to aperture 223, knob 230 can rotate away from or deeper into body 218. In some aspects, knob 230 can move proximally or distally along notch 232*e*, which can adjust an internal volume of assembly 200. This rotational and/or distal-proximal movement between knob 230, knob 232, and body 218 can cause an internal volume of assembly 200 to adjust between being larger and smaller. In the assembled state when knobs 230, 232 and body 218 are assembled with body 216, air flowing through opening 224 during exhalation can circulate in body 216, 218, and within knobs 230, 232 before egressing through respective apertures 254, 232*c* that are aligned with aperture 223.

On the opposite side of assembly 200, an outer exhaust valve cover 226 can be mountable over an inner exhaust valve cover 261. Cover 226 is more particularly shown in FIGS. 14, 15, 16A and 16B, which include perspective views of cover 226. Cover 226 can include an open end 226*a* configured to be mounted over cover 261. One or more exhaust valve apertures 228 can be radially arranged about walls between ends 226*a* and 226*b* of cover 226, whereby air from body 216 can egress through one or more of apertures 228 during exhalation. Apertures 228 in certain aspects can extend from end 226*b* at least partially along walls between end ends 226*a*, 226*b*. In aspects, apertures 228 can range in size to provide further control to end-users as to adjusting air level resistance during exhalation.

Figure 16A:
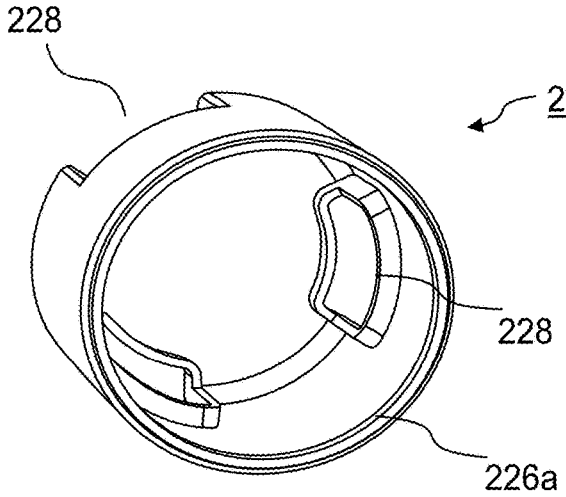
FIGS. 16A-16B depict perspective views of an outer exhaust valve cover of the oxygen trainer assembly of FIGS. 11A-11B.
Figure 16B:
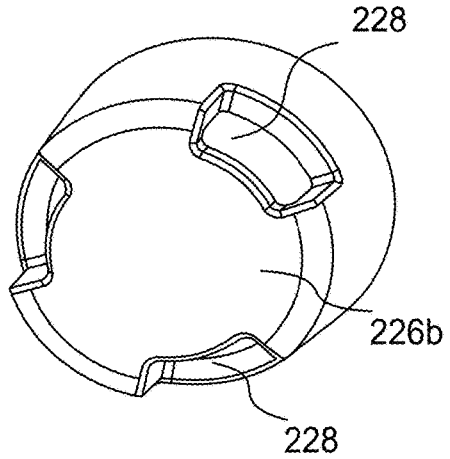
Figure 16C:
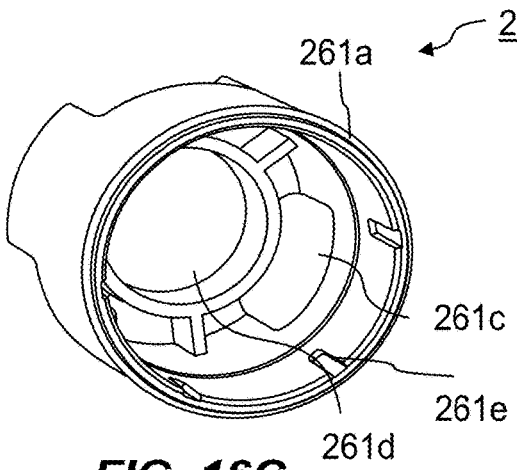
FIGS. 16C-16D depict perspective views of an inner exhaust valve cover of the oxygen trainer assembly of FIGS. 11A-11B.
Figure 16D:
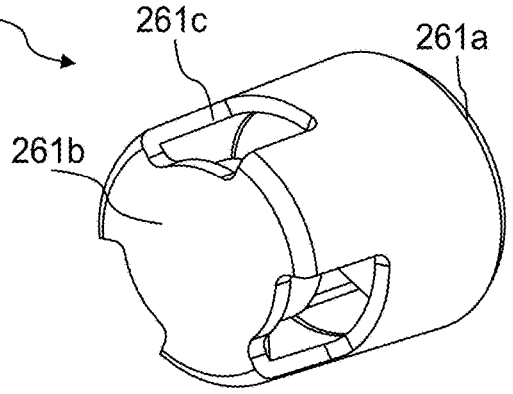

As shown in FIGS. 14-15, cover 261 can be nested within cover 226 when assembled with assembly 200, as in FIGS. 11A and 11B. Cover 261 is shown more particularly in FIGS. 16C and 16D, having an open end 261*a* opposite end 261*b*. End 261*b* is configured to snuggly sit against end 226*b* when cover 261 is nested within cover 226. One or more radially arranged notches 261*e* can be provided along an inner surface of cover 261 extended away from end 261*a*. A central recess 261*d* can be provided along end 261*b* over which one way valve 242 can be positioned. Similar to valve 42, valve seat 247 can be positioned with valve 242 so that air is unable to enter through covers 226, 261 during inhalation but can egress from body 216 through seat 247 and covers 226, 261 during exhalation. Valve seat 247 can couple to end by coupling to corresponding radially arranged notches or receivers of end 216*b*. Notches 261*e* of cover 261 can be configured couple with corresponding radial protrusions 247*e* of seat 247. In some aspects, once cover 226 is mounted over cover 261, which is assembled with seat 247, valve 242 and body 216, an end-user can advantageously rotate cover 226 relative to the rest of assembly 200 or only with respect to cover 261. In either context, throttling cover 226 relative to assembly 200 or only with respect to cover 261 can allow the end-user to precisely control an air level resistance during exhaustion.

Figure 19A:
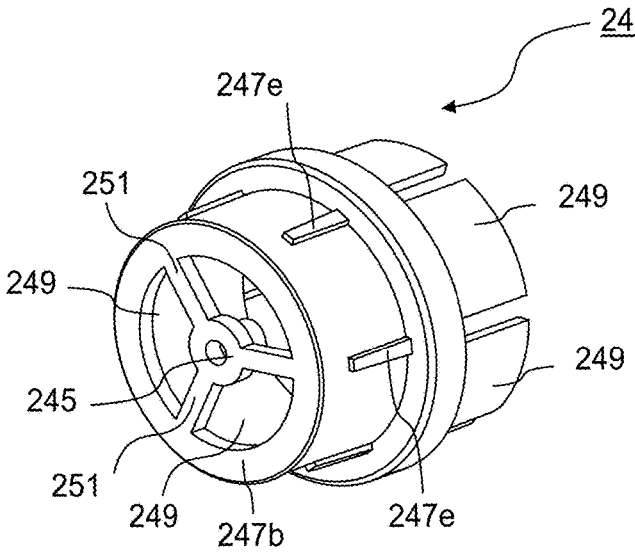
FIGS. 19A-19B depict perspective views of an exhaust valve body of the oxygen trainer assembly of FIGS. 11A-11B.
Figure 19B:
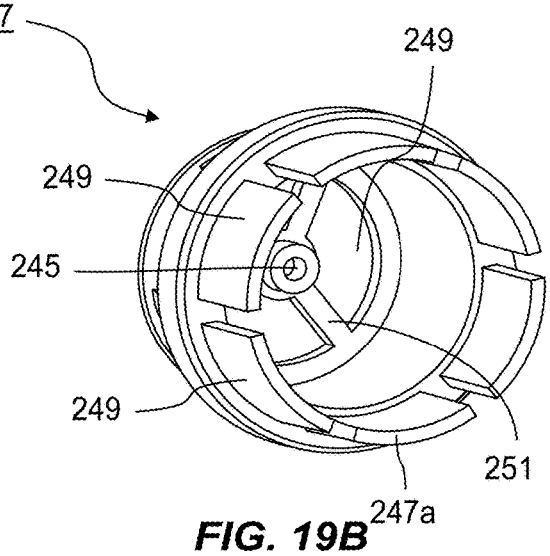
Figure 19C:
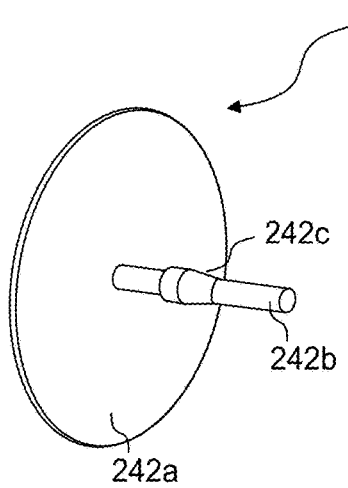
FIGS. 19C-19D depicts perspective views of a valve of the oxygen trainer assembly of FIGS. 11A-11B.
Figure 19D:
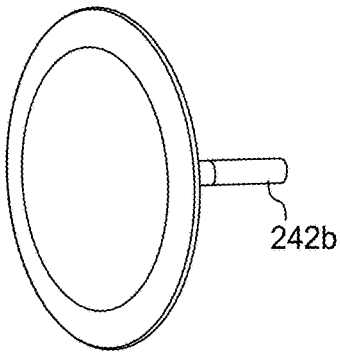

In particular, valve seat 247 is shown in FIGS. 19A and 19B including an open end 247*a* and an end 247*b* opposite therewith. One or more walls can extend between ends 247*a*, 247*b*. Similar to seat 47, central alignment aperture 245 can extend through end 247*b* with one or more strut members 251 radially extended between aperture 245 and end 247*b*. Portion 242*c* and member 242*b* of valve 242 can coupled with seat 247, similar to the arrangement previously shown in FIG. 2C. One or more gaps 249 can be formed between members 251 configured to permit air flow therethrough. Gap(s) 249 can be defined with a diameter less than a diameter of disc 242*a*.

Valve 242 being similar to valve 42, can be a one-way valve so that air that is prevented from passing by valve 242 during inhalation, as shown in FIG. 11A. Valve 242 is more particularly shown in FIGS. 14, 15, 19C and 19D. Valve 242 can include a disk 242*a*, which can be flexible (e.g., formed of an elastomer such as rubber) so as to permit fluid in one direction (e.g., exhalation) while closing in a seal state (e.g., inhalation) to prevent flow. In some aspects, the outer perimetral edge of disk 242*a* can be thinner than other portions of disk 42*a* so as to facilitate opening or closing of valve 242 during use. A rod like member 242*b* can extend from a central portion of disk 242*a* with a thicker rod portion 242*c* centrally located on member 242*b*. The outer diameter of disk 242*a* is configured to engage valve seat 247 with a diameter less than an inner diameter of covers 226, 261.

In this respect, during inhalation, disk 242*a* of valve 242 can provide a complete resistance to the passage of airflow by sealing against end 247*b* of valve seat 247 caused by a sealing or blockage between disc 242*a* and valve seat 247, which prevents air passing from aperture(s) 228 through valve 242. In contrast, during exhalation disc 242*a* can move away from seat 247 so as to permit egress of air from body 216 through seat 247 and ultimately aperture(s) 228, 261*c*.

In some aspects, the examples of FIGS. 11A to 21B can be considerably smaller as a result of the pair of different throttle subassemblies on opposite sides of body 218 which the user can use and control as desired. In some examples, the throttle subassemblies (e.g., knobs 230, 232 and covers 226, 261, respectively) can be removable and interchangeable. In some aspects, assembly 200 can include multiple sub throttle assemblies (e.g., a first set of knobs 230, 232 and a second set of knobs 230, 232 with different sized apertures than the first set of knobs 230, 232). For example, a first set of knobs 230, 232 can include apertures 254, 232*c* with openings having diameters that can range between 9-14 mm that signify an approximate volume equivalent for working out. The second set of knobs 230, 232 can include apertures 254, 232*c* with openings having diameters that can range between 1-8 mm that signify an approximate volume equivalent for respiratory training. Depending on a user's activity or inclination, the user can therefore swap respective sets of knobs 230, 232 depending on the activity. This same principle can apply to multiple different sets of covers 226, 261, depending on the activity.

Figure 22:
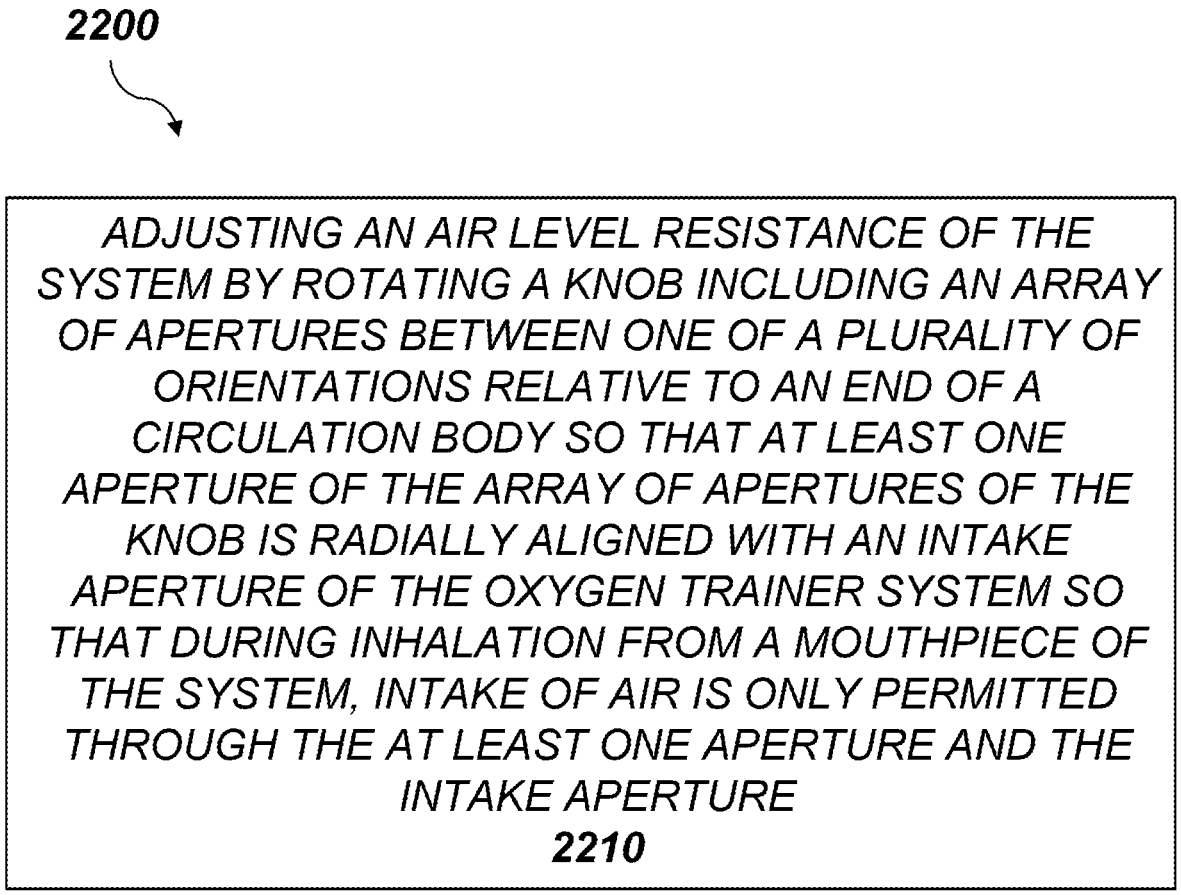
FIG. 22 depicts a flow diagram of a method of using an oxygen trainer assembly according to certain aspects of this disclosure.

FIG. 22 depicts a method 2200 of using any of the herein disclosed systems. Step 2210 of method 2200 can include adjusting an air level resistance of the system by rotating a knob including an array of apertures between one of a plurality of orientations relative to an end of a circulation body so that at least one aperture of the array of apertures of the knob is radially aligned with an intake aperture of the oxygen trainer system so that during inhalation from a mouthpiece of the system, intake of air is only permitted through the at least one aperture and the intake aperture. Method 2200 can end after step 2210. In other embodiments, additional steps according to the examples described above can be performed.

As discussed above, the oxygen trainer assemblies of this disclosure are innovative in that the level of air resistance between a plurality of integrally formed settings of the assembly may be readily modified by the mere adjustment of features of the assembly. No external or additional features (e.g., inserts or tabs) are necessary other than the adjustment by the user (e.g., rotation of a cover, valve seat, and/or the like). The oxygen trainer assemblies of this disclosure are further innovative in that their component parts may be relatively easy to assemble and disassemble, are portable, and may be able to be conveniently cleaned. As such, the oxygen trainer assemblies of this disclosure may be adopted to a variety of different uses, including aerobic and athletic training activities as well as breathing exercises for asthma, COPD, anxiety, PTSD, or any other condition, to increase inspiratory muscular endurance. The oxygen trainer assemblies may be maintained in a hygienic condition so as to reduce the transmission of germs through the mouthpiece. The oxygen trainer assemblies of this disclosure may reliably control the level of air resistance through features thereon, such as one or more circulation apertures, in order to improve the user's inspiratory muscular endurance during training.

The specific configurations, choice of materials and the size and shape of various elements can be varied according to particular design specifications or constraints requiring a system or method constructed according to the principles of the disclosed technology. Such changes are intended to be embraced within the scope of the disclosed technology. The presently disclosed embodiments, therefore, are considered in all respects to be illustrative and not restrictive. It will therefore be apparent from the foregoing that while particular forms of the disclosure have been illustrated and described, various modifications can be made without departing from the spirit and scope of the disclosure and all changes that come within the meaning and range of equivalents thereof are intended to be embraced therein.

What is claimed is:

1. An oxygen trainer system, comprising:

a circulation body attachable to and in fluid communication with a mouthpiece;

a valve seat coupled to a first end of the circulation body:

a valve cover mounted over the valve seat and the first end of the circulation body, the valve cover comprising one or more exhaust apertures;

a one-way valve coupled to the valve seat and within the valve cover, the valve configured to seal against the valve seat to prevent intake of air during inhalation into the circulation body from the one or more exhaust apertures;

a knob coupled to a second end of the circulation body, the knob comprising an open end with one or more walls extended to a second end opposite the first end and an array of apertures positioned on the one or more walls between the first and second ends;

wherein the valve cover, the valve seat, and one-way valve are separate components;

wherein the knob is rotatable so that at least one apertures of the array of apertures is alignable with an intake aperture of the oxygen trainer system to control an air level resistance of the oxygen trainer system; and wherein the apertures of the array of apertures are selectively positioned circumferentially along the knob in a spiral.

2. The oxygen trainer system of claim 1, wherein the first end of the circulation body is opposite the second end of the circulation body and the intake aperture is positioned adjacent the second end, and wherein the at least one of the apertures of the array of apertures is radially alignable with the intake aperture.

3. The oxygen trainer system of claim 1, wherein the circulation body is tubular.

4. The oxygen trainer system of claim 1, wherein the array of apertures comprise diameters ranging from approximately 1 mm and approximately 8 mm.

5. The oxygen trainer system of claim 1, further comprising the mouthpiece, the mouthpiece being detachable from a mouthpiece receiver of the circulation body between the first and second ends.

6. The oxygen trainer system of claim 1, wherein the one or more exhaust apertures are axially aligned with a longitudinal axis of the circulation body.

7. The oxygen trainer system of claim 1, wherein the knob further comprises an outer knob comprising the array of apertures coupled to and selectively aligned with an inner knob with a second array of apertures with the inner knob nested in the outer knob.

8. The oxygen trainer system of claim 1, further comprising a throttle body coupled to the second end of the circulation body, the knob being coupled to the second end of the circulation body via the throttle body, the throttle body comprising the intake aperture.

9. An oxygen trainer system, comprising:

a circulation body attachable to and in fluid communication with a mouthpiece;

a valve seat coupled to a first end of the circulation body;

a valve cover mounted over the valve seat and the first end of the circulation body, the valve cover comprising one or more exhaust apertures;

a one-way valve coupled to the valve seat and within the valve cover, the valve configured to seal against the valve seat to prevent intake of air during inhalation into the circulation body from the one or more exhaust apertures;

a knob coupled to a second end of the circulation body, the knob comprising an open end with one or more walls extended to a second end opposite the first end and an array of apertures positioned on the one or more walls between the first and second ends;

an exhaust valve cover nested within the valve cover, the exhaust valve cover comprising an array of apertures so that rotating the valve cover relative to at least one aperture of the array of apertures of the exhaust valve cover controls an air level resistance of the system during exhalation;

wherein the valve cover, the valve seat, and one-way valve are separate components;

wherein the knob is rotatable so that at least one apertures of the array of apertures is alignable with an intake aperture of the oxygen trainer system to control an air level resistance of the oxygen trainer system; and wherein the one or more exhaust apertures are radially arranged along an outer surface of the valve cover, the valve cover being rotatably coupled to the first end.

10. A method of using an oxygen trainer system, comprising:

positioning a one-way valve on a circulation body of the oxygen trainer system that seals against an exhaust valve seat to prevent intake of air into the circulation body from one or more exhaust apertures of a valve cover during inhalation and wherein the valve cover, the valve seat, and one-way valve are separate components;

nesting an inner valve cover within the valve cover, the inner valve cover comprising an array of apertures; and rotating the valve cover relative to at least one aperture of the array of apertures of the inner valve cover to control an air level resistance of the system during exhalation.

11. The method of claim 10, further comprising: adjusting an air level resistance of the oxygen trainer system by rotating a knob on an opposite side of the circulation body from the one-way valve and comprising an array of apertures between one of a plurality of orientations relative to an end of a circulation body so that at least one aperture of the array of apertures of the knob is radially aligned with an intake aperture of the oxygen trainer system so that during inhalation from a mouthpiece of the oxygen trainer system, intake of air is only permitted through the at least one aperture and the intake aperture.

12. The method of claim 11, the knob comprising an outer knob comprising the array of apertures coupled to and selectively aligned with an inner knob with a second array of apertures, the inner knob nested in the outer knob, the method further comprising: securely engaging the inner knob with the outer knob so that the array of apertures of the outer knob is aligned with an array of apertures of the inner knob.

13. The method of claim 12, the step of only permitting intake of air, during inhalation from the mouthpiece, comprising directing air through the at least one aperture of the outer knob, at least one aperture of the inner knob, and the intake aperture of the circulation body.

14. The method of claim 11, further comprising: moving the knob proximally or distally relative to the end of the circulation body to adjust an air volume of the system.

15. The method of claim 11, further comprising: positioning the array of apertures circumferentially along the knob in a spiral.

16. The method of claim 10, further comprising: axially aligning the one or more exhaust apertures with a longitudinal axis of the circulation body.

17. The method of claim 10, further comprising: radially arranging the one or more exhaust apertures along an outer surface of the valve cover, the valve cover being rotatably coupled to the opposite side of the circulation body.

* * * * *